US007425691B2

(12) United States Patent
Kinouchi et al.

(10) Patent No.: US 7,425,691 B2
(45) Date of Patent: Sep. 16, 2008

(54) COIL UNIT AND FIXING APPARATUS

(75) Inventors: Satoshi Kinouchi, Tokyo (JP); Osamu Takagi, Chofu (JP); Yoshinori Tsueda, Fuji (JP); Toshihiro Sone, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 119 days.

(21) Appl. No.: 11/263,980

(22) Filed: Nov. 2, 2005

(65) Prior Publication Data

US 2007/0095820 A1 May 3, 2007

(51) Int. Cl.
*H05B 6/14* (2006.01)
*G03G 15/20* (2006.01)

(52) U.S. Cl. ..... 219/619; 399/330; 399/329

(58) Field of Classification Search ..... 219/619, 219/672; 399/328–330, 90; 29/606
See application file for complete search history.

(56) References Cited

U.S. PATENT DOCUMENTS

| | | | | |
|---|---|---|---|---|
| 5,526,103 | A * | 6/1996 | Kato et al. | 399/328 |
| 6,078,781 | A | 6/2000 | Takagi et al. | |
| 6,097,926 | A | 8/2000 | Takagi et al. | |
| 6,337,969 | B1 | 1/2002 | Takagi et al. | |
| 6,415,128 | B1 | 7/2002 | Takagi et al. | |
| 6,861,627 | B2 | 3/2005 | Wasai et al. | |
| 2002/0175795 | A1 | 11/2002 | Fuseya et al. | |
| 2003/0227533 | A1 | 12/2003 | Yokoi | |
| 2004/0238531 | A1 | 12/2004 | Kikuchi et al. | |
| 2005/0040159 | A1 | 2/2005 | Wasai et al. | |

FOREIGN PATENT DOCUMENTS

| | | | |
|---|---|---|---|
| JP | 2001-228742 | A | 8/2001 |
| JP | 2002-056963 | A | 2/2002 |
| JP | 2003-068442 | A | 3/2003 |
| JP | 2004-013024 | A | 1/2004 |
| JP | 2004349103 | A * | 12/2004 |

OTHER PUBLICATIONS

U.S. Appl. No. 11/080,943, filed Mar. 16, 2005, Sone et al.

* cited by examiner

*Primary Examiner*—Quang T Van
(74) *Attorney, Agent, or Firm*—Foley & Lardner LLP

(57) ABSTRACT

A fixing apparatus includes a mold (holding member) formed by injection molding to hold a coil so that the coil maintains a predetermined positional relation with respect to a heating roller, and capable of holding a temperature sensor which detects a temperature of the heating roller and a thermostat which detects an abnormal temperature of the heating roller in predetermined positions facing the heating roller.

20 Claims, 13 Drawing Sheets

COIL UNIT AND FIXING APPARATUS

1. FIELD OF THE INVENTION

The present invention relates to a fixing apparatus which is mounted on an image forming apparatus, a copying machine, a printer or the like for forming an image on a transfer material by use of an electrophotographic process and which fixes, onto a transfer material, a developer on the transfer material, and a coil unit disposed in the fixing apparatus.

2. BACKGROUND OF THE INVENTION

As a method of heating a heating roller of a fixing apparatus, an example is known in which a heating member having an endless belt shape or a cylindrical (roller) shape is constituted of a heat-resistant film material including a metal layer (conductive film) having a small heat capacity, and brought into contact with a member to be fixed by use of induction heating.

An induction heating device passes a high-frequency current through a coil to generate electromagnetic waves, passes a current induced by the electromagnetic waves through the metal layer of the heating roller, and heats the heating roller by the Joule heat accompanying the induced current. When a frequency of the high-frequency current flowing through this coil is controlled, a surface temperature of the heating roller can be raised at a set temperature by the heating.

Such induction heating device has an advantage that it is possible to heat the heating roller in a short time. However, a high-precision temperature control is required in order to uniformly control the surface temperature of the heating roller in an axial direction. The coil is required to be held in a predetermined position with respect to the heating roller in order to achieve uniform magnetic characteristics of the metal layer of the heating roller and the coil in the axial direction.

However, there is a problem that when the high-frequency current is supplied to the coil, the coil vibrates a positional relation between the coil and the heating roller changes, and the magnetic characteristics change.

To solve the problem, as disclosed in Japanese Patent Application Laid-Open No. 2003-68442, a coil unit is known in which a coil holder 1 and a coil presser member 2 are manufactured by injection molding, next an electromagnetic induction coil 8 is attached to the coil holder 1, and the coil presser member 2 is bonded (fixed) to the holder. Moreover, the integrally bonded coil holder 1 and coil presser member 2, and the electromagnetic induction coil 8 are set into a mold for the injection molding to obtain a resin-sealing molded portion 3, thereby preventing the coil from being deformed or its position from being displaced.

However, in the coil unit disclosed in Jpn. Pat. Appln. KOKAI Publication No. 2003-68442, the electromagnetic induction coil 8 is held by the coil holder 1 and coil presser member 2 as support members, and the molded portion 3 constituted by the resin-sealing molding. Therefore, since at least three types of molds are required for forming the coil holder member 1, the coil presser member 2, and the molded portion 3, respectively, a molding process becomes complicated, and this sometimes raises costs.

Moreover, when the coil is not securely held in a coil drawing portion, a lead wire of the coil comes into contact with the mold to break the coating of an electric wire, and the lead wire is sometimes disconnected.

BRIEF SUMMARY OF THE INVENTION

According to an aspect of the present invention, there is provided a coil unit comprising:

a coil having a first surface and a second surface disposed on a side opposite to the first surface;

a first holding member which holds the coil disposed facing the first surface;

a magnetic core disposed at a predetermined interval from the second surface of the coil; and a second holding member filled between the coil and the magnetic core.

According to another aspect of the present invention, there is provided a fixing apparatus comprising:

a heating roller which supplies heat to a recording medium;

a pressurizing roller which is brought into contact with the heating roller under pressure while applying a predetermined pressure to the heating roller; and a heating device provided with a coil unit which induction-heats the heating roller, the coil unit including: a coil having a first surface, a second surface disposed on a side opposite to the first surface, and a coil hole positioned in the center; a first mold which is provided with a first support portion disposed in the coil hole and which holds the coil disposed facing the first surface; a magnetic core disposed at a predetermined interval from the second surface of the coil; and a second mold having a shape which is long in a first direction, formed by injection molding to cover peripheral surfaces of the coil and the magnetic core, and filled between the coil and the magnetic core.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

First Embodiment

There will be described hereinafter one example of a fixing apparatus to which an embodiment of the present invention is applied with reference to the drawings.

Figure 1:
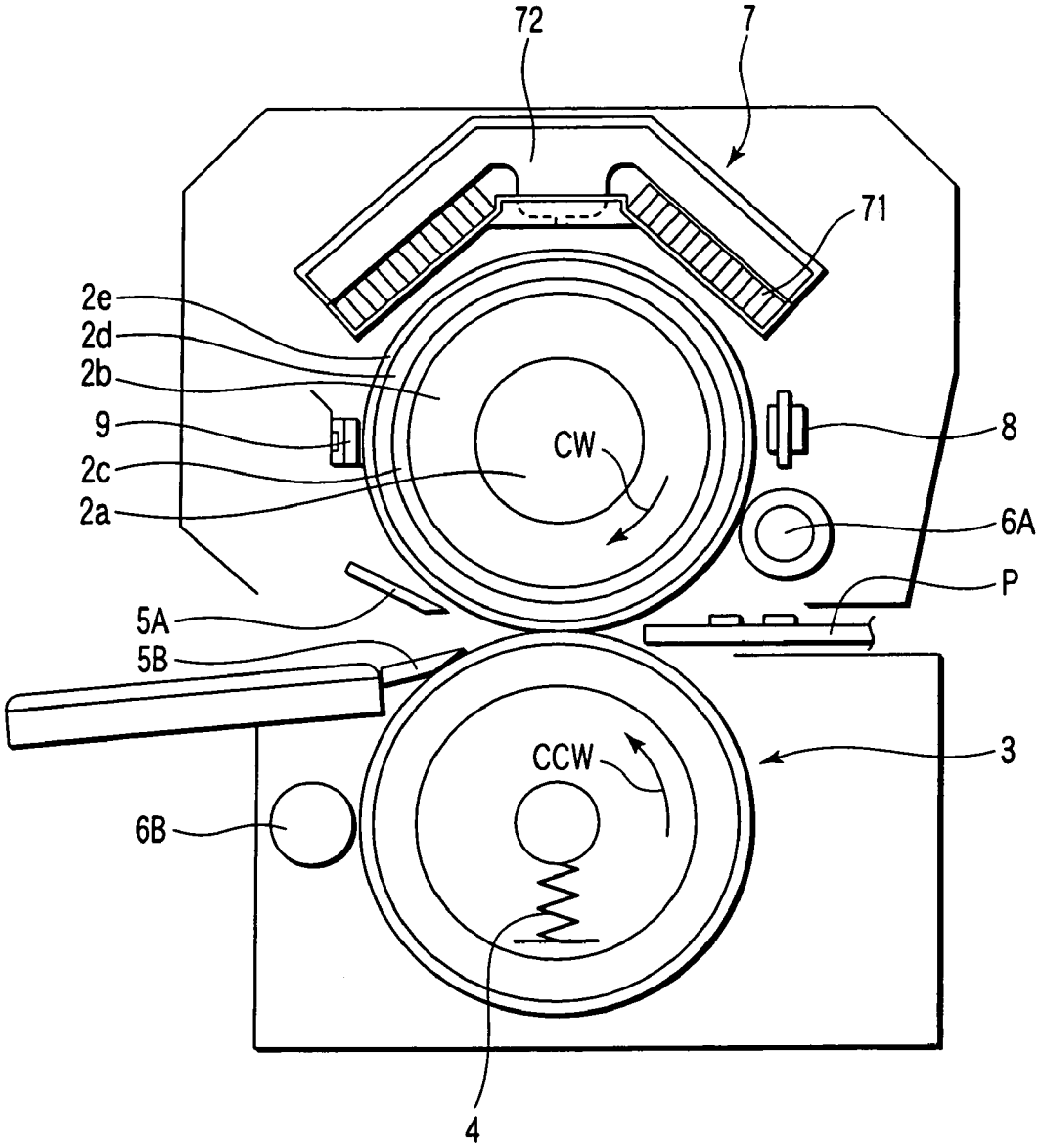
FIG. 1 is a schematic diagram showing one example of a fixing apparatus to which an embodiment of the present invention is applicable.

FIG. 1 shows one example of the fixing apparatus to which the embodiment of the present invention is applied.

As shown in FIG. 1, a fixing apparatus 1 has a heating member (heating roller) 2, a pressurizing member (pressing roller) 3, a pressurizing spring 4, peeling claws 5A, 5B, cleaning rollers 6A, 6B, an induction heating device 7, a temperature sensor 8, and a thermostat (abnormal temperature detecting section) 9.

The heating roller 2 includes: a shaft 2*a* constituted of a material having rigidity (hardness) such that the material is not deformed at a predetermined pressure; and an elastic layer (foam rubber layer, sponge layer, and silicon rubber layer) 2*b*, a conductive layer (metal conductive layer) 2*c*, a solid rubber layer 2*d* constituted of a thin-film layer made of a heat-resistant silicone rubber or the like, and a release layer 2*e* which are arranged in order around the shaft 2*a*. The metal conductive layer 2*c* is formed of a conductive material (e.g., nickel, stainless steel, aluminum, a composite material of copper, stainless steel, and aluminum or the like), and made of nickel in the present embodiment. The foam rubber layer 2*b* is preferably formed a thickness of 5 to 10 mm, the metal conductive layer 2*c* 10 to 100 μm, and the solid rubber layer 2*d* 100 to 200 μm, respectively. In the present embodiment, the foam rubber layer 2*b* is formed a thickness of 5 mm, the metal conductive layer 2*c* 40 μm, the solid rubber layer 2*d* 200 μm, and the release layer 2*e* 30 μm, respectively. Each of the heating roller 2 and the pressurizing roller 3 is formed a diameter of 40 mm.

The pressurizing roller 3 may be an elastic roller constituted by coating a periphery of a rotation shaft having a predetermined diameter with a silicone rubber or a fluorine rubber having a predetermined thickness, or a roller having a metal conductive layer and an elastic layer in the same manner as in the heating roller 2.

The pressurizing spring 4 is brought into contact with the heating roller 2 under a predetermined pressure in an axial direction, and the heating roller 2 is maintained in parallel with an axial line of the heating roller 2.

The heating roller 2 is rotated in a direction of an arrow CW (clockwise) at a generally constant speed by predetermined driving means (not shown). The pressurizing roller 3 is brought into contact with the heating roller 2 under the predetermined pressure by the pressurizing spring 4. Therefore, when the heating roller 2 is rotated, the pressurizing roller 3 is rotated in a direction (of on arrow CCW (counterclockwise)) opposite to a direction in which the heating roller 2 is rotated in a position where the pressurizing roller is in contact with the heating roller 2.

The peeling claw 5A is positioned in a predetermined position in the vicinity of a nip portion on a periphery of the heating roller 2 on a downstream side from the nip portion in which the heating roller 2 and the pressurizing roller 3 contact each other in a direction in which the heating roller 2 is rotated. The peeling claw peels, from the heating roller 2, a sheet P attached to the heating roller 2. The peeling claw 5B is disposed on a periphery of the pressurizing roller 3 on the downstream side in the rotating direction of the pressurizing roller 3 in the nip portion, and peels the sheet P attached to the pressurizing roller 3 from the pressurizing roller 3. The cleaning rollers 6A, 6B remove wastes such as offset toner and paper attached to the surface of the heating roller 2 or the pressurizing roller 3.

The induction heating device 7 is disposed outwardly from the heating roller 2, and includes: a coil structure 71 which supplies a predetermined magnetic field to the heating roller 2 to induction-heat the metal conductive layer 2*c* of the heating roller 2; and a magnetic core 72 disposed outside this coil structure 71.

A plurality of temperature sensors 8 are disposed in an axial direction of the heating roller 2 while they are not brought into contact with the surface of the heating roller 2. The sensors detect a temperature of an outer peripheral surface of the heating roller 2. In the present embodiment, thermopile sensors are used in the non-contact temperature sensors 8.

The thermostat 9 is utilized for detecting heating abnormality indicating that the surface temperature of the heating roller 2 abnormally rises, and interrupting a power supplied to the coil structure 71 of the induction heating device 7 in a case where the heating abnormality is generated. It is to be noted that at least one or more thermostats 9 are preferably disposed in the vicinity of the surface of the heating roller 2.

In a case where the fixing apparatus 1 fixes a toner image to the passing sheet P, a predetermined power is supplied to the coil structure 71 of the induction heating device 7 to generate a magnetic field in accordance with the power. When eddy currents flow through the metal conductive layer 2*c* owing to this magnetic field, the metal conductive layer 2*c* generates heat. Moreover, when the sheet P holding toner T passes through the nip portion formed between the heating roller 2 whose surface temperature rises to a fixing temperature and the pressurizing roller 3, the molten toner T is attached to the sheet P under pressure, and the image is fixed.

The temperature sensor 8 outputs detected temperature information as a voltage value. To be more specific, the detected temperature of the heating roller 2 is calculated based on an output value (voltage value) from a thermopile (not shown) included in the non-contact temperature sensor 8, and an output value (voltage value) of a thermistor which detects the temperature of the thermopile.

The power supplied to the induction heating device 7 is controlled based on the detected temperature information from this non-contact temperature sensor 8.

Next, the induction heating device 7 of the present embodiment will be described in more detail with reference to FIGS. 2 to 7.

Figure 2:
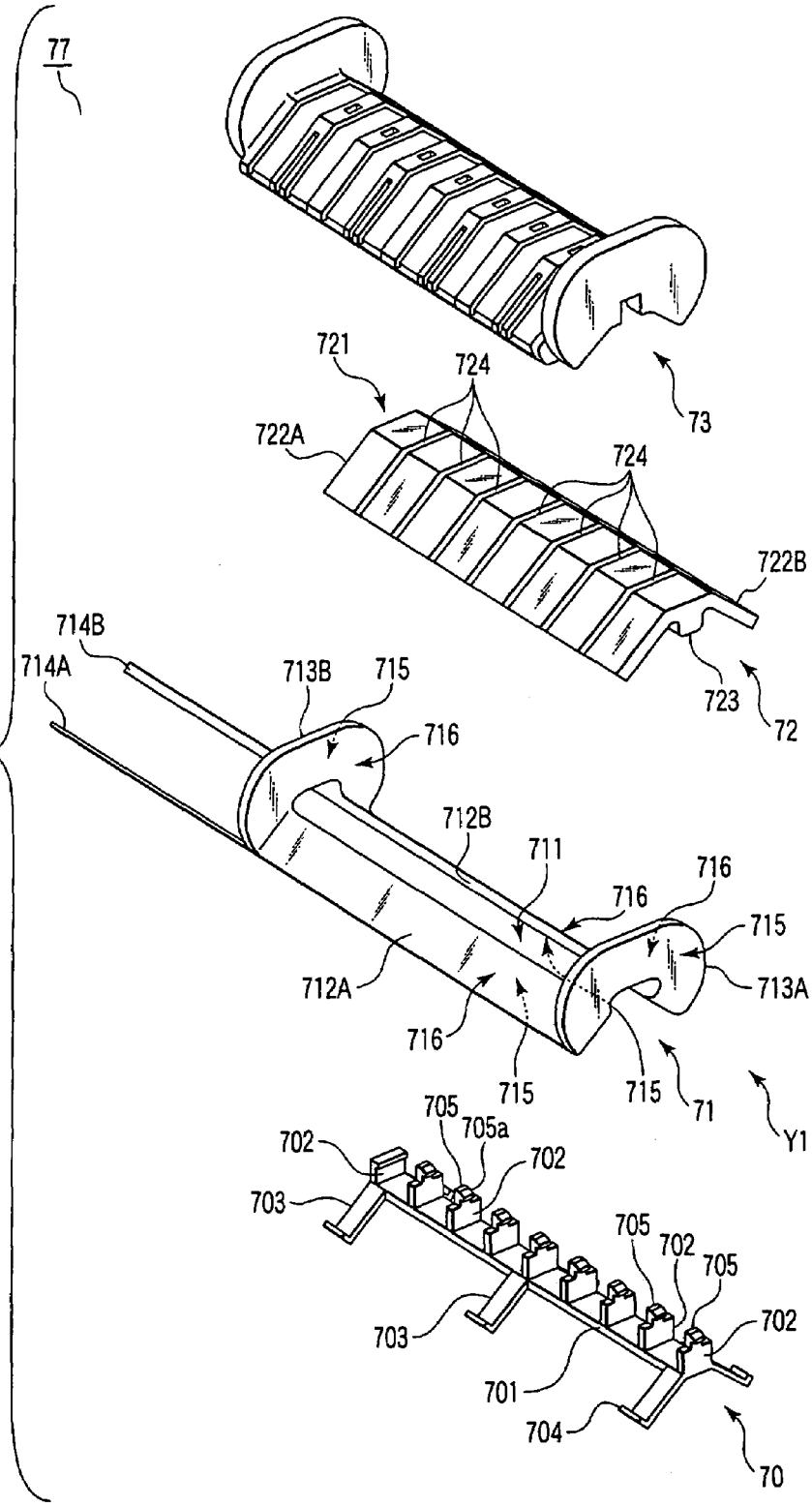
FIG. 2 is a schematic perspective view showing a constitution of a coil unit applicable to the fixing apparatus shown in FIG. 1.

As shown in FIG. 2, the induction heating device 7 includes a coil unit 77. This coil unit 77 includes: a coil holder 70 (first holding member, first mold); the coil structure 71; the magnetic core 72; and a coil mold (second holding member, second mold) 73 which integrally holds the coil holder 70, the coil structure 71, and the magnetic core 72.

The coil structure 71 is a wound coil constituted by winding one electric wire around an imaginary shaft, and has an elongated coil hole 711 in this imaginary shaft area. The coil structure 71 includes coil central portions 712A, 712B disposed to sandwich the coil hole 711 therebetween and constituted of a bunch of electric wires extending in a longitudinal direction (first direction) of the coil hole 711. The coil central portions 712A, 712B continue via a coil end portion 713A constituted of a fan-shape bunch of electric wires in one end, and continue via a coil end portion 713B constituted of a fan-shaped bunch of electric wires in the other end. It is to be noted that lead wires 714A, 714B of the coil structure 71 are both drawn from one end of the coil structure 71 in the longitudinal direction.

Figure 3:
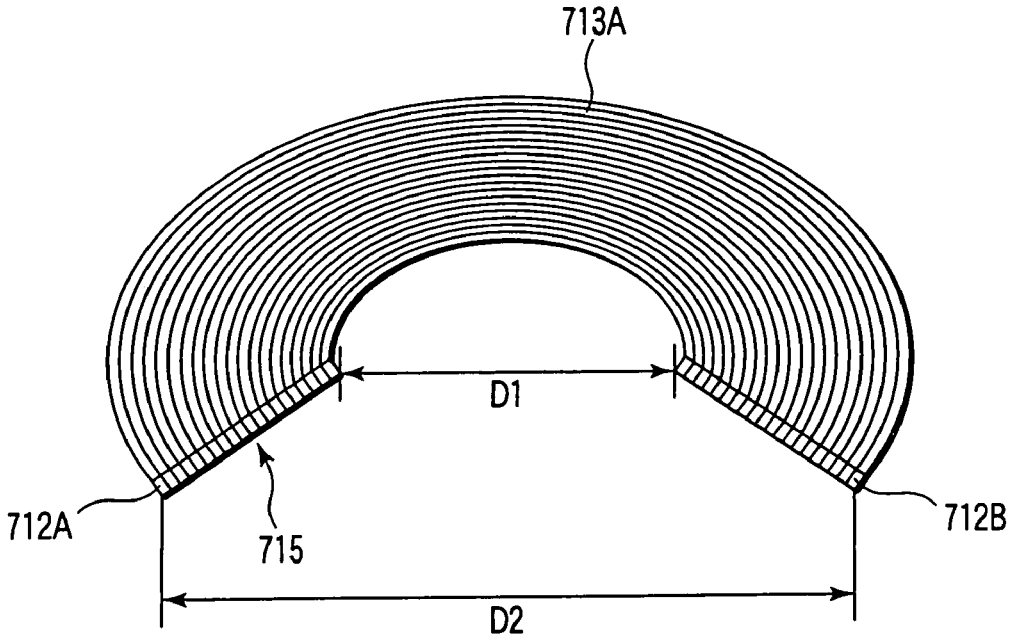
FIG. 3 is a schematic perspective view of a coil structure shown in FIG. 2.

The coil structure 71 has a lower surface (first surface) 715 on a side facing the coil holder 70, and an upper surface (second surface) 716 on a side facing the magnetic core 72. As shown in FIG. 3, the coil central portions 712A, 712B are inclined in a direction in which the respective lower surfaces 715, 715 as viewed from an end portion of the longitudinal direction. The coil end portions 713A, 713B are raised so that the respective upper surfaces 716, 716 face each other. That is, as shown in FIG. 3, the coil central portions 712A, 712B come close to each other on a side near the coil hole 711, and gradually leave from each other toward the outside of the coil structure 71 as viewed from one end (Y1 direction of FIG. 2) of the longitudinal direction.

To be more specific, as shown in FIG. 3, a distance D1 between the coil central portions 712A and 712B close to the coil hole 711 is smaller than a distance D2 between outer edges of the coil central portions 712A and 712B. The distance between the coil central portions 712A and 712B gradually increases from the distance D1 toward the distance D2. In the present embodiment, the coil central portions 712A, 712B are linearly formed on the side of the lower surfaces 715, 715. It is to be noted that the present invention is not limited to this embodiment, and for example, the lower surfaces 715 of the coil central portions 712A, 712B may be curved in accordance with a shape of the facing heating roller 2.

Figure 4:
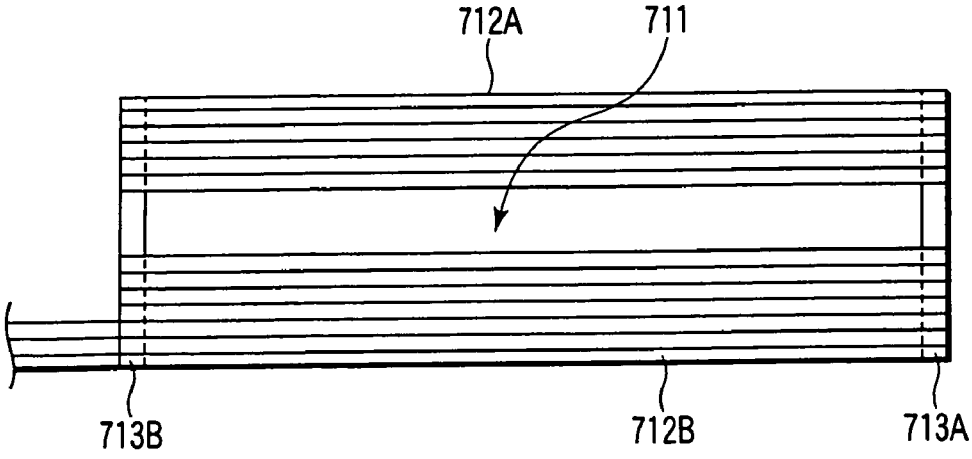
FIG. 4 is a schematic perspective view of the coil structure shown in FIG. 2.

Moreover, the fan-shaped coil end portions 713A, 713B are raised on the side of the upper surfaces 716. Therefore, when the coil structure 71 is viewed from the lower surface 715, as shown in FIG. 4, the coil central portions 712A, 712B constituted of the electric wires extending in the longitudinal direction of the coil hole 711 are disposed on the side of the lower surface 715 of the coil structure 71, and the fan-shaped coil end portions 713A, 713B are retreated on the side of the upper surface 716. Therefore, the lower surface 715 of the coil structure 71 is disposed facing the heating roller 2, the coil central portions 712A, 712B constituted of the electric wires of a straight-line portion extending in the axial direction are disposed facing the heating roller. Therefore, the magnetic field generated from the coil structure 71 (coil central portions 712A, 712B) can be uniformly supplied to the facing heating roller 2. When the coil structure 71 having such shape is utilized, magnetic flux can be concentrated, and the heating roller 2 can be locally heated in a concentrated manner.

The coil holder 70 includes: a main body portion (first support portion) 701 formed into an elongated shape in accordance with the shape of the coil hole 711 of the coil structure 71; a plurality of ribs 702 disposed at predetermined intervals in the longitudinal direction on the main body portion 701; and a plurality of beam portions 703 extending to spread downwards in accordance with tilts of the coil central portions 712A, 712B of the coil structure 71.

The opposite-end ribs among the plurality of ribs 702 abut on the coil end portions 713A, 713B of the coil structure 71, respectively, in a state in which the coil structure 71 is held by the coil holder 70, thereby preventing the coil structure 71 from being moved in the longitudinal direction. The beam portions 703 are provided with engaging portions 704 on tips thereof to abut on the respective outer edges of the coil central portions 712A, 712B of the coil structure 71, thereby preventing the coil structure 71 from being moved in a short direction. Accordingly, the coil structure 71 is preliminarily fixed to the coil holder 70.

Moreover, the plurality of ribs 702 of the coil holder 70 are provided with a plurality of holder protruding portions 705 (first position matching portion) which position the magnetic core 72 and which preliminarily fix the magnetic core 72 held by the coil holder 70 so that the core is immobile. It is to be noted that a tip of each holder protruding portion 705 is provided with a claw member 705*a* protruding a little in the longitudinal direction, and the claw member 705*a* can be fitted into each groove 724 disposed in the magnetic core 72 as described later to thereby hold the magnetic core 72 in the predetermined position.

The magnetic core 72 includes: a central portion (second support portion) 721 corresponding to the main body portion (first support portion) 701 of the coil holder 70; and inclined portions 722A, 722B bent downwards to extend along the coil central portions 712A, 712B of the coil structure 71, respectively. The central portion 721 include: a plurality of magnetic core protruding portions 723 corresponding to the plurality of ribs 702; and a plurality of grooves 724 (second position matching portion) corresponding to the plurality of holder protruding portions 705 and claw members 705*a* disposed on the plurality of ribs 702.

Figure 5:
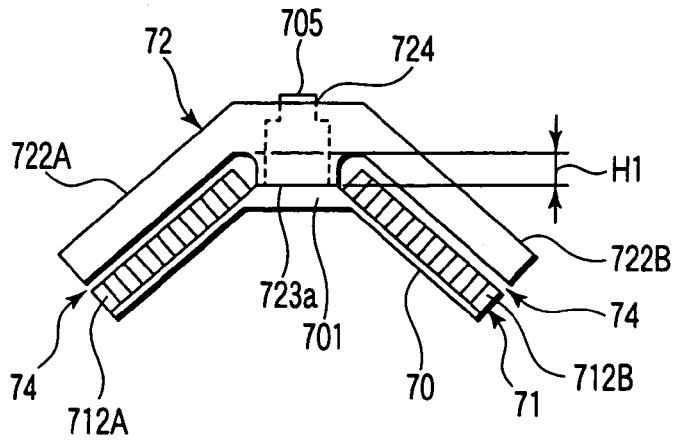
FIG. 5 is a schematic sectional view showing a constitution of the coil unit shown in FIG. 2.

The plurality of magnetic core protruding portions 723 are disposed at predetermined intervals corresponding to the plurality of ribs 702 so that each protruding portion is inserted between the ribs 702. The magnetic core protruding portions 723 are held by the coil holder 70 holding the coil structure 71 so that each magnetic core protruding portion 723 is disposed between the ribs 702. In this state, as shown in FIG. 5, an upper surface 723*a* of each magnetic core protruding portion 723 abuts on the main body portion 701 of the coil holder 70 between the ribs 702. In this case, as shown in FIG. 5, gaps 74 are formed between the coil central portions 712A, 712B of the coil structure 71 and the inclined portions 722A, 722B of the magnetic core 72. In the central portion 721 of the magnetic core 72, the coil holder 70 and the magnetic core 72 are fixed while a distance H1 is made therebetween.

As described above, since the magnetic core 72 is disposed in the coil holder 70 to engage the plurality of ribs 702 with the magnetic core protruding portions 723, the coil structure 71 and the magnetic core 72 are prevented from being moved in the longitudinal direction. The holder protruding portions 705 and the claw members 705*a* of the coil holder 70 are fitted into the grooves 724 of the magnetic core 72. Accordingly, the coil structure 71 and the magnetic core 72 are prevented from being moved in the short direction. When the holder protruding portions 705 are fitted into the groove 724, the claw members 705*a* are caught by an outer surface of the magnetic core 72 (the surface opposite to the coil structure 71). Therefore, the magnetic core 72 is not detached from the coil holder 70.

The coil central portions 712A, 712B of the coil structure 71 are disposed substantially parallel to the inclined portions 722A, 722B of the magnetic core 72, respectively, and the gap 74 has a certain length in the longitudinal direction. In the present embodiment, the gap 74 is 0.5 mm long. As the electric wire of the coil structure 71, there is applicable a litz wire constituted by bundling a plurality of electric wires whose surfaces are insulating-treated and which are subjected to a self fusing treatment for heating and accordingly fusing the wires. When the electric wires subjected to the self fusing treatment, rigidity of the self fused coil structure 71 can be enhanced, the coil structure 71 can be prevented from being deformed, and an insulating performance can be enhanced. In the present embodiment, there is used the litz wire constituted by bundling 19 copper wire materials each having a diameter of 0.5 mm, whose surfaces are insulating-treated using heat-resistant polyamide imide. When the litz wire is constituted using the copper wire material having a small linear diameter (0.5 mm), a size of the wire can be set to be smaller than a penetration depth of each copper wire material, and it is therefore possible to utilize an alternating current flowing through the coil structure 71 with good efficiency.

The coil mold 73 is formed by injection-molding an insulating material. As the insulating material, a polyphenylene sulfide (PPS) resin is usable. However, the material is not limited to this resin, and a resin such as a phenol resin, a glass-containing resin, carbon, ceramic or the like may be used. A resin having a heat resistance is preferable which is not thermally deformed owing to heat convection by the heating roller 2.

It is to be noted that this coil mold 73 is not a single component. The coil mold is formed integrally with the coil holder 70, the coil structure 71, and the magnetic core 72, and thereafter injection-molded together with them by a manufacturing method described later.

Figure 6:
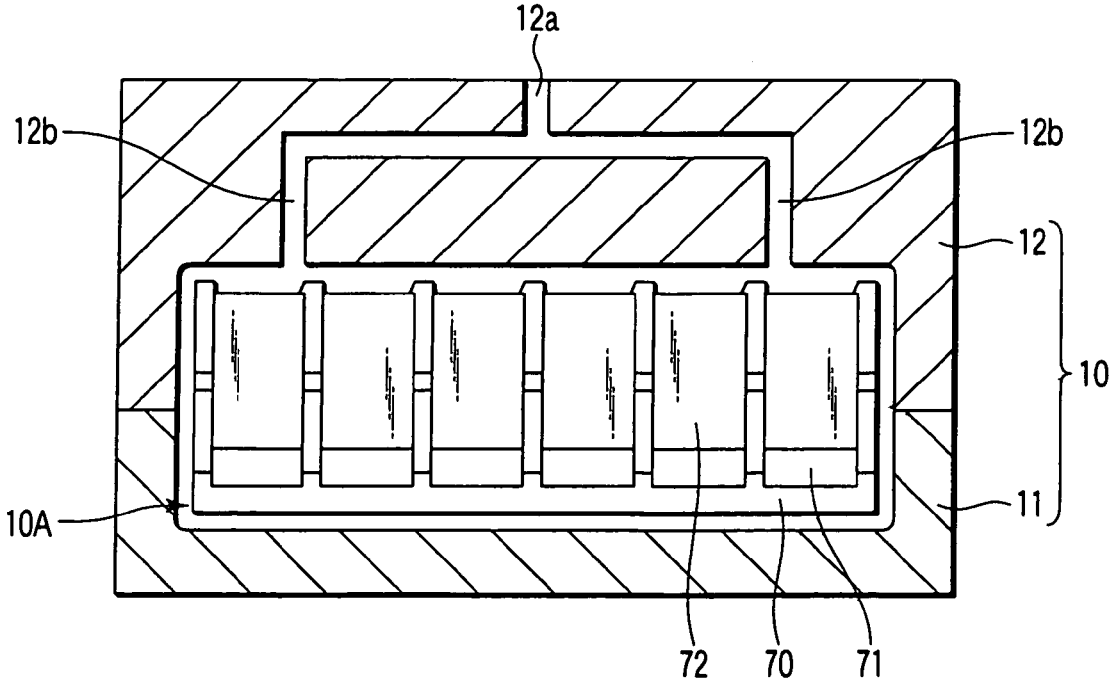
FIG. 6 is a schematic diagram showing a mold for use in injection-molding the coil unit applicable to the fixing apparatus shown in FIG. 1, and the coil unit.

Next, a method of manufacturing the induction heating device 7 will be described. FIG. 6 shows a schematic sectional view of a mold 10 for manufacturing the coil unit 77 by the injection molding.

As shown in FIG. 6, the mold 10 includes a first mold 11 and a second mold 12, and is provided with a mold structure for forming the coil mold 73 into a predetermined shape in a space 10A formed by connecting the first mold 11 to the second mold 12. For example, although not shown, the mold 10 has a mold structure capable of injection-molding arrangement areas or the like of an abutting portion (not shown) which abuts on the shaft 2*a* of the heating roller 2 to fix the coil unit 77 to the heating roller 2 while retaining a predetermined interval from the heating roller 2, and another portion that can be disposed in the coil unit 77.

The first mold 11 has a structure for stably disposing the coil holder 70 which holds the coil structure 71 and the magnetic core 72. The first mold 11 is provided with a positioning and fixing member (not shown) which holds the disposed coil holder 70 in a position corresponding to a mold structure of the coil unit 77 and which fixes the disposed coil holder 70 to prevent the holder from being moved in a case where a molten resin as a material of the coil mold 73 is injected. The second mold 12 is provided with a gate 12*a* and a channel 12*b* to be filled with the molten resin (mold material).

First, the coil structure 71 having a shape shown in FIG. 2 is manufactured. In the present embodiment, after the electric wire constituting the coil structure 71 is formed into a saddle shape, a predetermined current is passed to melt the surface of the electric wire subjected to the self fusing treatment, and each electric wire is bonded and fixed.

Next, the coil structure 71 is disposed in the coil holder 70 to dispose the plurality of ribs 702 of the coil holder 70 in the coil hole 711 of the coil structure 71. Furthermore, the plurality of ribs 702 are engaged with the magnetic core protruding portions 723 from above the coil structure 71, and the holder protruding portions 705 are fitted into the grooves 724 to dispose the magnetic core 72 in the coil holder 70.

Consequently, the coil structure 71 and the magnetic core 72 are positioned with respect to the coil holder 70, and preliminarily fixed.

The coil holder 70 holding the preliminarily fixed coil structure 71 and magnetic core 72 is disposed in a predetermined position of the first mold 11 shown in FIG. 6. Moreover, the first mold 11 is connected to the second mold 12, that is, the mold is clamped, and the molten resin material is injected from the gate 12*a* of the second mold 12 to fill the space 10A with the resin material. Accordingly, the surfaces of the coil structure 71 and the magnetic core 72 are coated with the resin material, and the gap 74 formed between the coil structure 71 and the magnetic core 72 is filled with the resin material. That is, the coil mold 73 is injection-molded.

Figure 7:
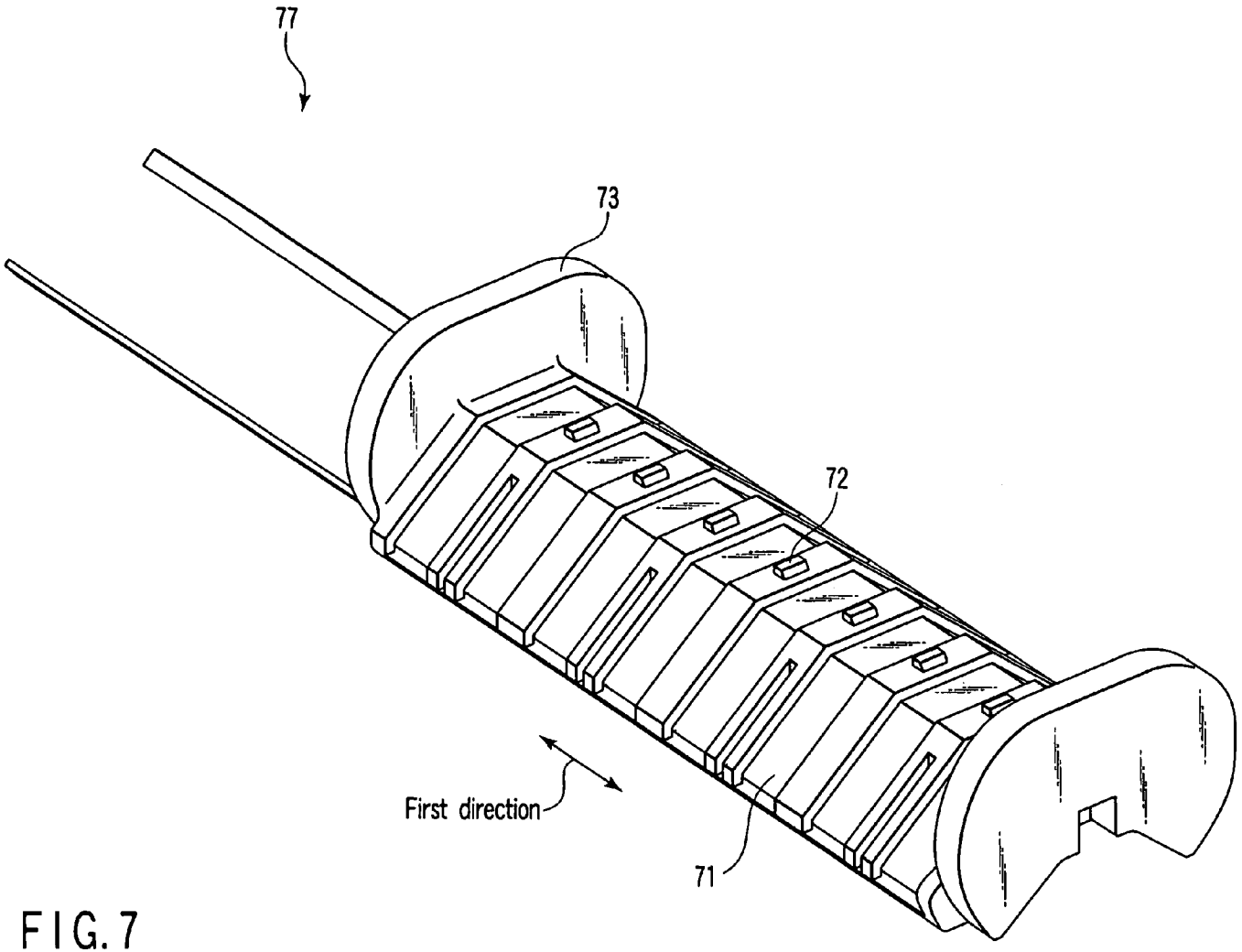
FIG. 7 is a schematic perspective view showing an integrally molded constitution of the coil unit shown in FIG. 2.

Consequently, the coil mold 73 having an elongated shape in the longitudinal direction (first direction) is formed as shown in FIG. 7, and the coil holder 70, the coil structure 71, and the magnetic core 72 are integrally held by the coil mold 73. It is to be noted that as shown in FIG. 7, the coil mold 73 does not have to cover the whole surface of the coil holder 70, coil structure 71, or magnetic core 72, and a part of the coil structure 71 or the magnetic core 72 may be exposed.

As described above, when the coil mold 73 is formed by the injection molding, the coil structure 71 and the magnetic core 72 can be integrally formed in a positioned state. Accordingly, there can be provided the coil unit in which a positional relation between the coil structure 71 and the magnetic core 72 is fixed. Therefore, it is possible to avoid a situation the positional relation between the 71 and the magnetic core 72 changes owing to vibration or the like.

It is to be noted that a molding temperature of the coil holder 70 as the first holding member is different from that of the coil mold 73 as the second holding member.

In the present embodiment, the coil holder 70 and the coil mold 73 are made of a PPS resin, and the coil holder 70 is injection-molded by use of a mold (not shown). In this case, a mold temperature is set at 80° C. as molding conditions. On the other hand, as the molding conditions of the coil mold 73, the mold temperature is set at 120° C. Since the molding temperature as the molding condition of the coil holder 70 is set to be lower than that of the coil mold 73, the coil holder 70 is slightly softened by the heat of the coil mold 73 during the injection molding of the coil mold 73. Accordingly, tightness between the resins is enhanced, and a bonding property between the coil holder 70 and the coil mold 73 can be improved.

It is to be noted that, needless to say, the respective mold temperatures (molding conditions) differ in a case where the coil holder 70 and the coil mold 73 are constituted of different materials.

Incidentally, the use of a heat-resistant insulating resin tape such as a kapton tape has heretofore been known in insulating means of the coil structure 71 and the magnetic core 72. However, as in the present invention, the molding material (resin material) is injected into the gap 74 formed between the coil structure 71 and the magnetic core 72. Accordingly, since the coil structure 71 and the magnetic core 72 can be subjected to an insulating treatment simultaneously with the forming of the coil mold 73, the above-described heat-resistant insulating resin tape is unnecessary, and manufacturing costs can be reduced. Since an adhesive for attaching the kapton tape to the coil structure 71, the magnetic core 72 or the like is not required, the present embodiment is useful for an environmental measure.

It is to be noted that as another method of subjecting the coil structure 71 and the magnetic core 72 to the insulating treatment simultaneously with the molding of the coil mold 73, a plate (third holding member) constituted of the same material as that of the coil mold 73 may be disposed beforehand between the coil structure 71 and the magnetic core 72 (not shown). When the plate is disposed between the coil structure 71 and the magnetic core 72 in this manner, a certain gap can be securely disposed between the coil structure 71 and the magnetic core 72. It is to be noted that the resin constituting this plane and that constituting the coil mold 73 adhere to each other, and insulating properties of the coil structure 71 and the magnetic core 72 can be secured. Even in this case, the kapton tape or the adhesive is not used. Although the number of components increases by one, the coil unit 77 can be constituted, and a similar effect can be obtained.

Moreover, in the coil unit 77 of the present embodiment, at least a front portion of the first surface 715 of the coil structure 71 is preferably covered with the coil mold 73. Accordingly, the insulating properties of the coil structure 71 and the heating roller 2 can be secured. Therefore, as a material of the coil unit 77, it is possible to apply a resin material, a non-magnetic metal, or an iron-based material which is not induction-heated by the efficiency generated from the coil structure 71. In the present embodiment, there is not utilized a material which is induction-heated at a frequency of 20 to 100 kHz of the current supplied to the coil structure 71.

In the present embodiment, a thickness from the side of the coil unit 77 facing the heating roller 2, that is, the outer peripheral surface of the coil unit 77 to the lower surface 715 of the coil structure 71 is formed into 0.5 mm.

It is to be noted that in the present embodiment, it has been described that the coil unit 77 is formed by the injection molding after positioning and disposing, in the mold 10, the coil structure 71 and magnetic core 72 preliminarily fixed by the coil holder 70. However, the present invention is not limited to this embodiment, and there may be disposed: a constitution to set the coil structure 71 in a predetermined position in an area of the first mold 11 of the mold 10, in which the coil structure 71 is disposed; and a constitution in which the magnetic core 72 is set in a predetermined position at a predetermined gap from the coil structure 71, so that the coil structure 71 and the magnetic core 72 are formed by the injection molding without using the coil holder 70. Accordingly, since the mold 10 only may be used as the mold of the coil unit 77, the manufacturing costs can be reduced more.

Figure 8:
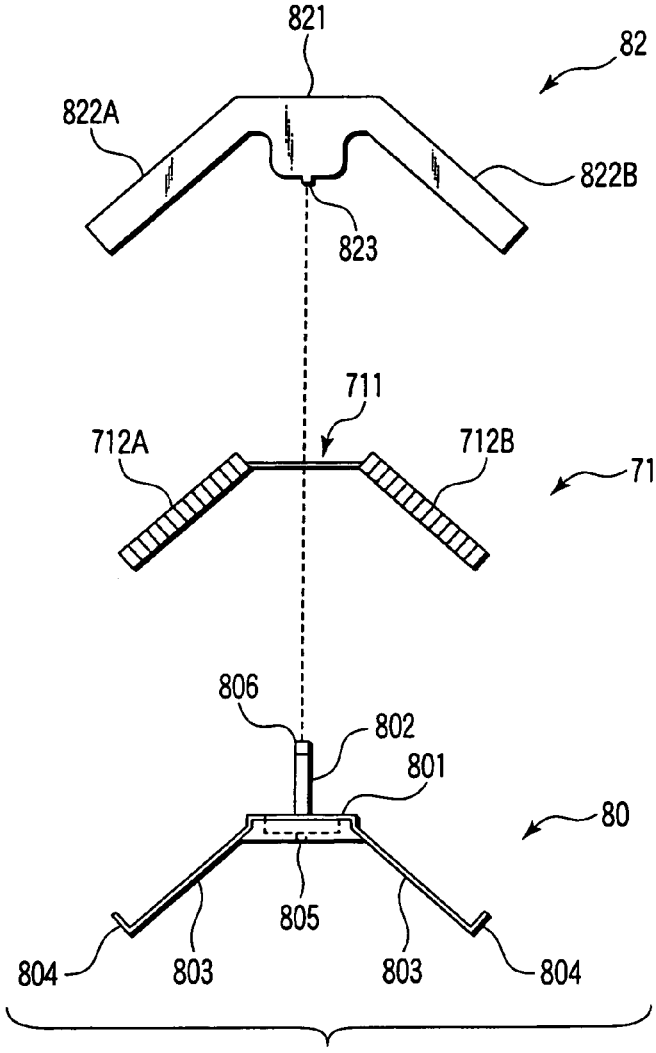
FIG. 8 is a schematic sectional view showing another example applicable to the coil unit shown in FIG. 2.
Figure 9:
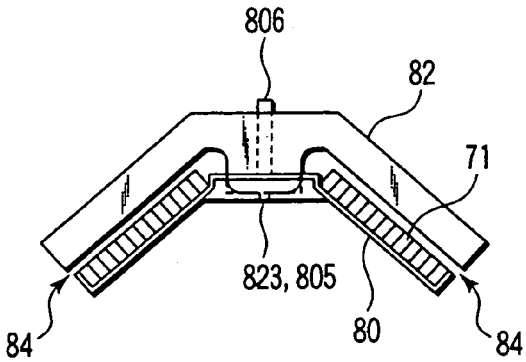
FIG. 9 is a schematic sectional view showing an assembled state of the constitution of the coil unit shown in FIG. 8.

Moreover, the present invention is not limited to this embodiment, and may be provided with a structure shown in FIGS. 8 and 9. It is to be noted that the above-described coil structure 71 is applicable as a coil structure.

FIG. 8 shows a schematic sectional view of a coil holder 80, the coil structure 71, and a magnetic core 82.

The coil holder 80 shown in FIG. 8 includes: a main body portion 801 having a size corresponding to that of the coil hole 711 of the coil structure 71; a plurality of ribs 802 disposed at predetermined intervals in the longitudinal direction on the main body portion 801; and a plurality of beam portions 803 extending to spread downwards along the tilts of the coil central portions 712A, 712B of the coil structure 71 from the main body portion 801 in a short direction crossing the longitudinal direction at right angles. The main body portion 801 has a constitution in which the coil hole 711 of the coil structure 71 is set on the main body portion 801 to thereby preliminarily fix the coil structure 71 so that the coil structure is prevented from being moved. The beam portions 803 are provided with engaging portions 804 on tips thereof. When the coil structure 71 is held by the coil holder 80, the engaging portions abut on outer edges of the coil central portions 712A, 712B of the coil structure 71 to prevent the coil structure 71 from being moved in the short direction.

Holder recessed portions 805 whose positions are matched with a position of the magnetic core 82 are disposed in opposite ends of the main body portion 801 of the coil holder 80 in the longitudinal direction.

The magnetic core 82 includes: a central portion (support portion) 821 corresponding to the main body portion 801 of the coil holder 80; and inclined portions 822A, 822B bent downwards to correspond to the coil central portions 712A, 712B of the coil structure 71, respectively. Opposite end portions of the central portion 821 are provided with magnetic core protruding portions 823 corresponding to the holder recessed portions 805 of the coil holder 80.

The coil hole 711 of the coil structure 71 is aligned with the main body portion 801 of the coil holder 80 having such constitution to dispose the coil structure 71 in the coil holder 80. Furthermore, the holder recessed portions 805 of the coil holder 80 are matched with the magnetic core protruding portions 823 of the magnetic core 82 to dispose the magnetic core 82 on the coil structure 71. Accordingly, as shown in FIG. 9, the magnetic core protruding portions 823 of the magnetic core 82 are fitted into the holder recessed portions 805 of the coil holder 80, and the coil structure 71 and the magnetic core 82 are preliminarily fixed to the coil holder 80 in the positioned state. It is to be noted that as to the magnetic core 82, the central portion 821 provided with the magnetic core protruding portions 823 abuts on the main body portion 801 provided with the holder recessed portions 805 of the coil holder 80, and accordingly a predetermined gap 84 is secured between the magnetic core and the coil structure 71.

Consequently, in a case where a coil mold (not shown) is injection-molded using the mold 10 as described above with reference to FIG. 6, a resin layer is formed in the gap 84 between the coil structure 71 and the magnetic core 82.

It is to be noted that as shown in FIGS. 8 and 9, in the coil holder 80, on each rib 802, there is disposed a holder protruding portion 806 for preliminarily fixing the magnetic core 82 to prevent the core from being moved in a state in which the core is held in the coil holder 80 in the same manner as in the coil holder 70. The magnetic core 82 is provided with a groove (not shown) corresponding to the holder protruding portion 806 in the same manner as in the magnetic core 72. When the holder protruding portion 806 is fitted into the groove, the coil holder 80 and the magnetic core 82 can hold the coil structure 71.

Second Embodiment

Next, there will be described another example of an induction heating device applicable to the present embodiment.

Figure 10:
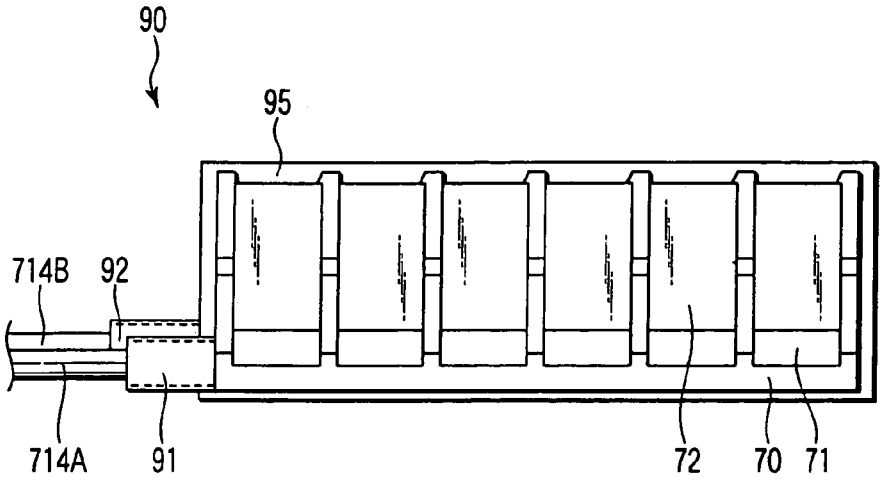
FIG. 10 is a schematic perspective view showing an example which is different from the coil unit shown in FIG. 7.

The induction heating device applicable to the present embodiment is provided with a coil unit 90 shown in FIG. 10.

As shown in FIG. 10, the coil unit 90 includes: a coil holder 70 having a constitution similar to the above-described constitution; a coil structure 71; a magnetic core 72; and a coil mold 95 which integrally holds the coil holder 70, the coil structure 71, and the magnetic core 72.

In one end of the coil mold 95 in the longitudinal direction, there are disposed: a first sleeve (protecting member) 91 which passes a lead wire 714A of the coil structure 71; and a second sleeve 92 which passes a lead wire 714B of the coil structure 71. That is, the lead wires 714A, 714B are drawn from the coil mold 95 via the first and second sleeves 91 and 92.

The first and second sleeves 91 and 92 are cylindrical members having inner diameters corresponding to linear diameters of the lead wires 714A, 714B. In the present embodiment, cylindrical members made of copper plated with tin and each having an outer diameter of 5 mm, a thickness of 0.5 mm, and a length of 10 mm are applied as the first and second sleeves 91 and 92.

The first and second sleeves 91 and 92 are bonded to the lead wires 714A, 714B disposed in the sleeves via a heat-resistant adhesive, and completely closely attached via the adhesive, respectively. In the present embodiment, a heat-resistant silicon adhesive is utilized as the heat-resistant adhesive.

A method of manufacturing the coil unit 90 will be described with reference to FIG. 11.

Figure 11:
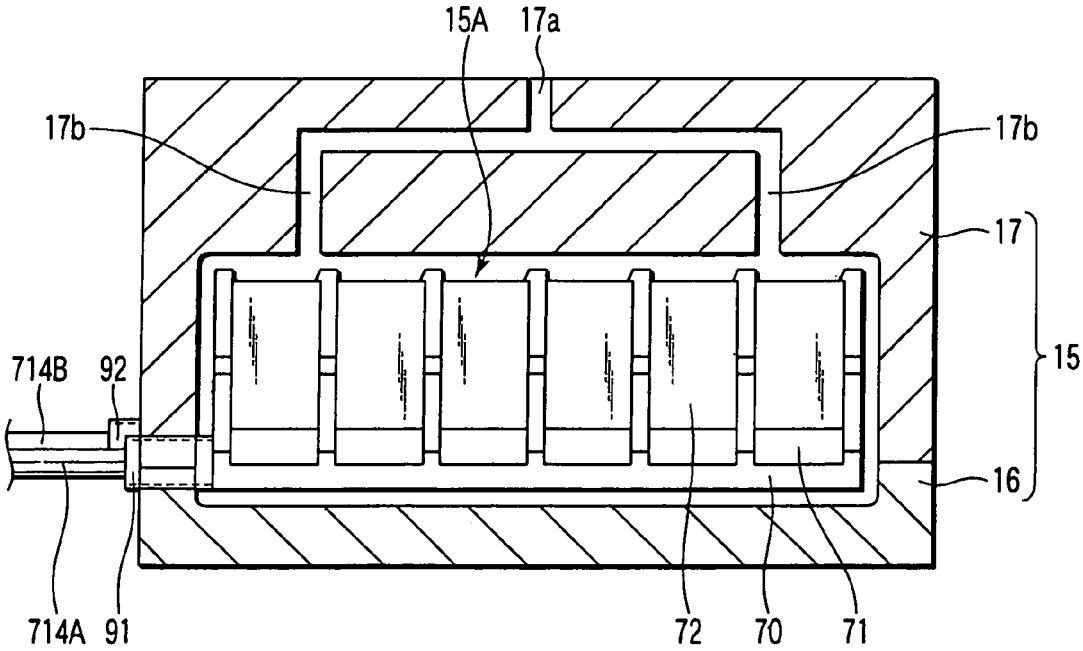
FIG. 11 is a schematic diagram showing a mold for use in injection-molding the coil unit shown in FIG. 10, and the coil unit.

As shown in FIG. 11, a mold 15 includes a first mold 16 and a second mold 17, and has a space 15A therein in a state in which the first mold 16 is connected to the second mold 17. The space 15A has a mold structure for forming the coil mold 95 into a predetermined shape.

The first mold 16 has a structure for stably disposing the coil holder 70 which holds the coil structure 71 and the magnetic core 72 in the space 15A. In the structure, the first and second sleeves 91 and 92 for protecting the lead wires 714A, 714B from the coil structure 71, respectively, are disposed in end portions of the space 15A in a longitudinal direction. The first mold 16 is provided with a positioning and fixing member (not shown) which holds the disposed coil holder 70, first sleeve 91, and second sleeve 92 in a position corresponding to a mold structure and which fixes the disposed coil holder 70, first sleeve 91, and second sleeve 92 to prevent them from being moved in a case where a molding material is injected. The second mold 17 is provided with a gate 17*a* and a channel 17*b* to be filled with a material (e.g., resin) of the coil mold 95. The second mold 17 has, in one end portion, a structure in which the mold is closely attached to the first and second sleeves 91 and 92 in a connected state to the first mold 16 to seal the space 15A with the proviso that the gate 17*a* is secured.

After the coil structure 71 is formed into a saddle shape as described above with respect to FIG. 2, a predetermined current is supplied to melt the surface of an electric wire subjected to a self fusing treatment, and each electric wire is bonded and fixed. The lead wire 714A of the coil structure 71 is passed through the first sleeve 91, a heat-resistant adhesive is injected between the lead wire 714A and the first sleeve 91, and the lead wire 714A is fixed and completely closely attached to the first sleeve 91 to fill in a gap between the lead wire 714A and the first sleeve 91. Similarly, the lead wire 714B is passed through the second sleeve 92, and the lead wire 714B is bonded to the second sleeve 92 via a heat-resistant adhesive to fill in a gap.

The coil structure 71 in which the sleeves 91, 92 are bonded to the lead wires 714A, 714B in this manner, respectively, is positioned and disposed in the coil holder 70. The magnetic core 72 positioned and disposed on the coil structure 71 is positioned and disposed in a predetermined position of the first mold 16. In this case, the first and second sleeves 91 and 92 are also positioned and disposed in portions formed in the end portions of the first mold 16, in which the first and second sleeves 91 and 92 are to be disposed.

Moreover, the first mold 16 is connected to the second mold 17 (the mold is clamped), the molten resin material is injected from the gate 17*a* of the second mold 17 in a state in which the space 15A is sealed, and the space 15A is filled with the resin material. Accordingly, the surfaces of the coil structure 71 and the magnetic core 72 are coated with the resin material, and the gap 74 formed between the coil structure 71 and the magnetic core 72 is filled with the resin material.

According to such constitution, since the lead wires 714A, 714B in a connected portion between the first and second molds 16 and 17 are protected by the sleeves 91, 92, it is possible to avoid a situation in which the lead wires 714A, 714B of the coil structure 71 are compressed and broken at a time when the first mold 16 is connected to the second mold 17 (the mold is clamped). Since the lead wires 714A, 714B are protected by the first sleeve 91 or the second sleeve 92, the lead wires 714A, 714B are not directly damaged by the mold 15. Furthermore, since the lead wires 714A, 714B and the sleeves 91, 92 are sealed via the adhesive, respectively, the filling resin material does not leak from the vicinity of the lead wires 714A, 714B during the injection molding by the mold 15.

It is to be noted that it has been described that the first and second sleeves 91 and 92 are made of copper, but the present invention is not limited to this embodiment. For example, the sleeves may be constituted of the same resin material as that of the coil mold 95, or a non-magnetic metal. Additionally, in a case where the first and second sleeves 91 and 92 are constituted of iron-based materials, a material is applicable which is not induction-heated by an magnetic field generated from the coil structure 71.

Moreover, in a case where a gap between the lead wire and the sleeve is small, since a large amount of the resin material injected during the injection molding does not leak, the lead wire does not have to be bonded to the sleeve via the heat-resistant adhesive.

Furthermore, the lead wire may be covered with an annular elastic member (e.g., rubber) instead of the sleeve which protects the lead wire. In this case, this elastic member has an inner diameter smaller than that a linear diameter of the lead wire, and is closely attached to the lead wire in a case where the lead wire is tightened. Accordingly, it is possible to avoid a situation in which the injected resin material leaks between the lead wire and the annular elastic member during the injection molding. It is to be noted that as the annular elastic member, an elastic material having a heat resistance is preferable, and a silicone rubber is utilized in the present embodiment.

Third Embodiment

Next, there will be described another example of an induction heating device applicable to the present embodiment.

Figure 12:
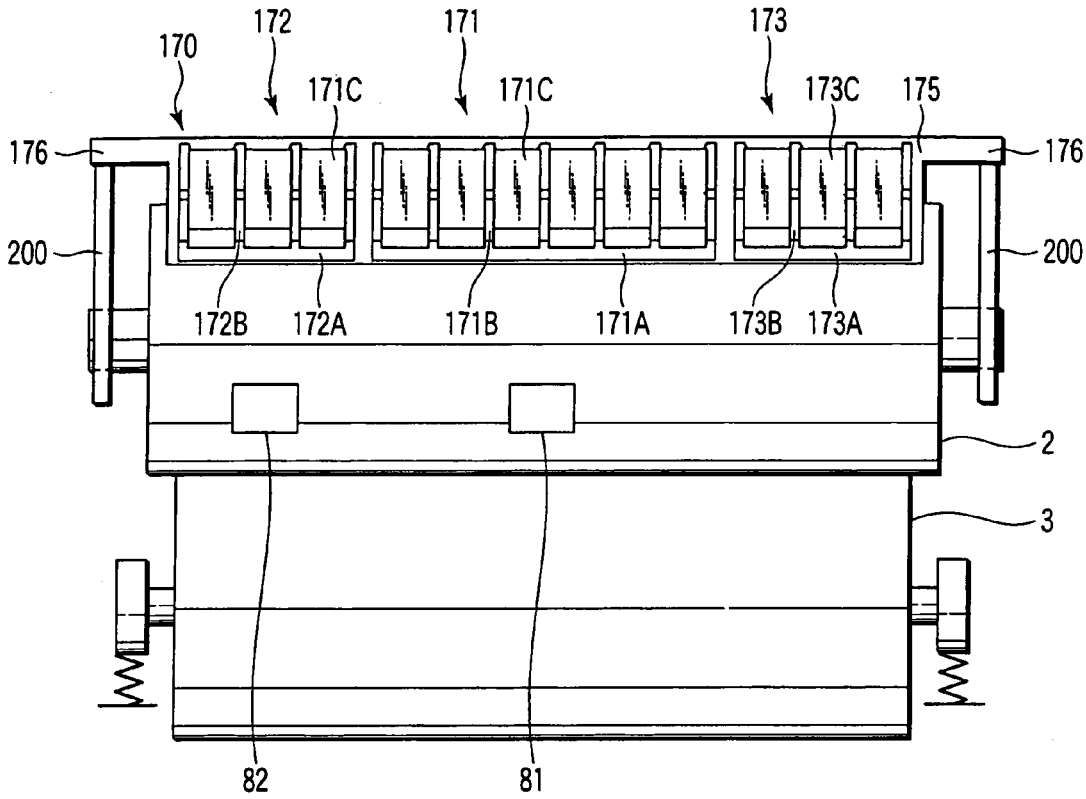
FIG. 12 is a schematic diagram showing another example of the coil unit applicable to the fixing apparatus shown in FIG. 1.

The induction heating device applicable to the present embodiment is provided with a coil unit 170 shown in FIG. 12.

As shown in FIG. 12, the coil unit 170 includes coil units 171, 172, and 173 molded integrally by use of an injection-molded coil mold 175.

The coil units 171; 172, and 173 have: coil holders 171A, 172A, and 173A each having a constitution similar to that of the coil holder 70; coil structures 171B, 172B, and 173B each having a constitution similar to that of the coil structure 71; and magnetic cores 171C, 172C, and 173C each having a constitution similar to that of the magnetic core 72. The coil structure 171B is disposed facing a central portion of the heating roller 2 in an axial direction, and supplies a magnetic field to the central portion of the heating roller 2. The coil structures 172B, 173B are disposed facing end portions of the heating roller 2 in the axial direction, and supply a magnetic field to the end portions of the heating roller 2.

Figure 13:
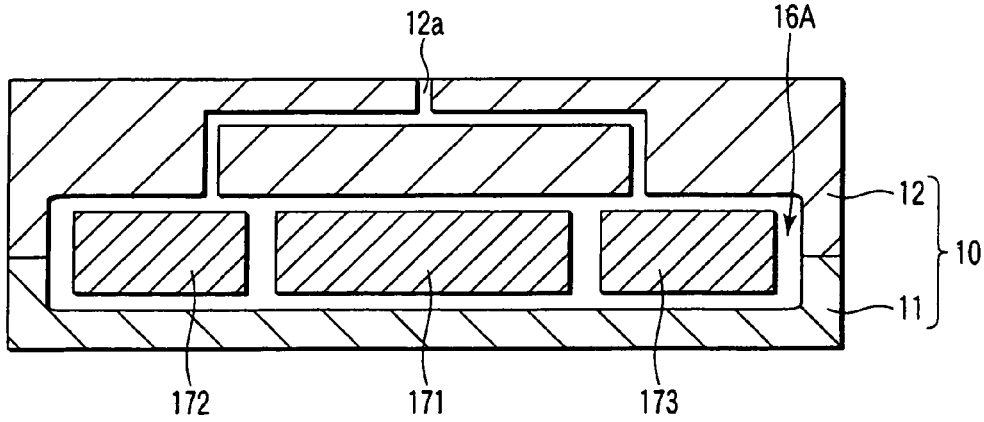
FIG. 13 is a schematic diagram showing a mold for use in injection-molding the coil unit shown in FIG. 12, and the coil unit.

As shown in FIG. 13, the coil units 171, 172, and 173 are arranged (positioned) in one row in a predetermined position of a mold 10 having a space 10A, and integrally molded of a resin injected from a gate 12*a* and molten as the coil mold 175. That is, a peripheral surface of the coil unit 170 is covered, and an insulating layer constituted of the same resin material as that of the coil mold 73 is formed between each of the coil structures 171B, 172B, and 173B and each of the magnetic cores 171C, 172C, and 173C.

Moreover, the coil mold 175 has, in opposite ends of the longitudinal direction, abutting portions 176 which abut on abutment portions 200 fixed to a heating roller 2 via a shaft 2*a* of the heating roller 2 to position the heating roller 2 and the coil unit 170.

In the vicinity of the surface of the heating roller 2, there are disposed: a non-contact temperature sensor (first temperature detecting section) 81 which detects the temperature of the surface of the heating roller 2 facing the coil structure 171B; and a non-contact temperature sensor (second temperature detecting section) 82 which detects the temperature of the surface of the heating roller 2 facing the coil structure 172B.

In the present embodiment, the coil structures 172B and 173B constitute one coil connected in series, and are equally controlled by the above-described controller.

When the plurality of coil units 171 to 173 are integrally molded by use of the coil mold 175 in the injection molding, the plurality of coil units 171 to 173 are fixed in the respective positioned predetermined positions, and therefore a positional precision among the coil structures 171B to 173B is improved. The coil unit 170 is provided with the abutting portions 176 on the opposite ends thereof, and fixed in a state in which the unit is positioned with respect to the heating roller 2. Therefore, the positional precision between the facing heating roller 2 and each of the coil structures 171B to 173B does not fluctuate among the respective coil structures, and a distance between the heating roller 2 and each of the coil structures 171B to 173B can be maintained to be constant. Consequently, heating unevenness of the heating roller 2 is prevented, and the heating roller 2 can be uniformly heated by a plurality of coils.

It is to be noted that the coil unit 170 may be provided with a protecting member (sleeve) as described in the second embodiment. In this case, electric wires drawn from the plurality of coil structures 171B to 173B may be provided with the protecting members, respectively. Alternatively, two lead wires of the coil structure 171 may be bonded to a pair of protecting members, and four lead wires of the coil structures 172 and 173 may be bonded to a pair of protecting members.

Moreover, the coil unit 170 including the plurality of coil structures 171B to 173B is disclosed in the prior U.S. patent application Ser. No. 10/445,210 filed May 27, 2003, the entire contents of which are incorporated herein by reference.

Fourth Embodiment

Next, there will be described another example of a fixing apparatus applicable to the present embodiment.

Figure 14:
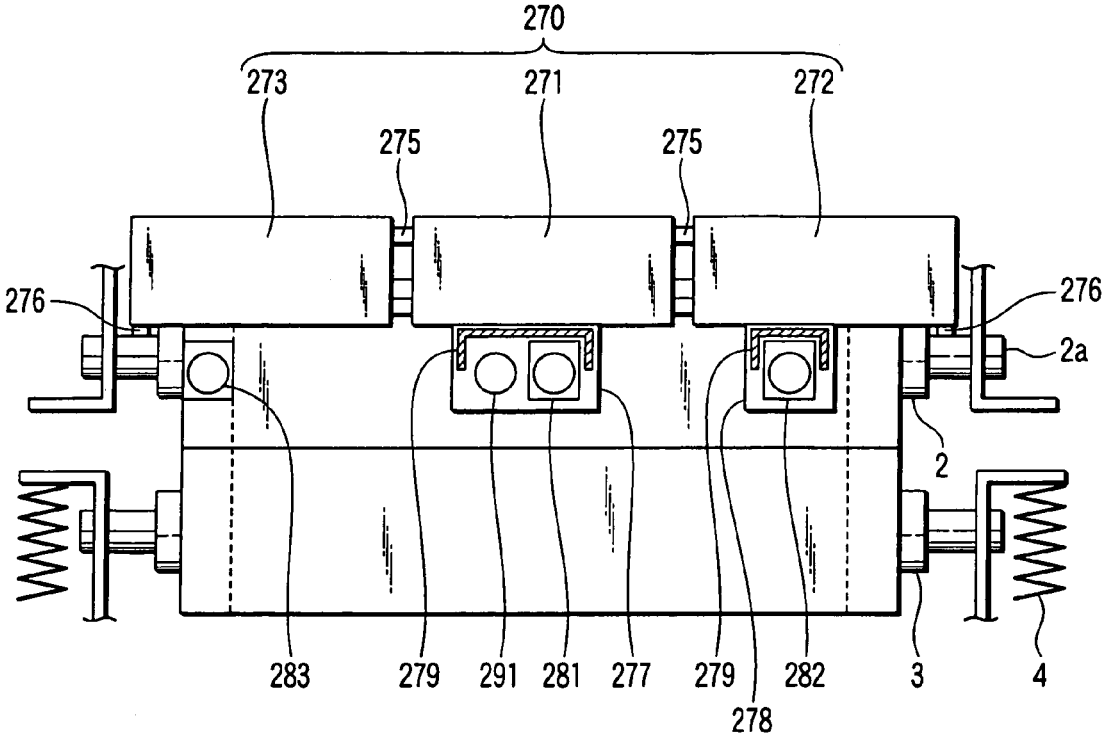
FIG. 14 is a schematic diagram showing another example of the coil unit applicable to the fixing apparatus shown in FIG. 1.
Figure 15:
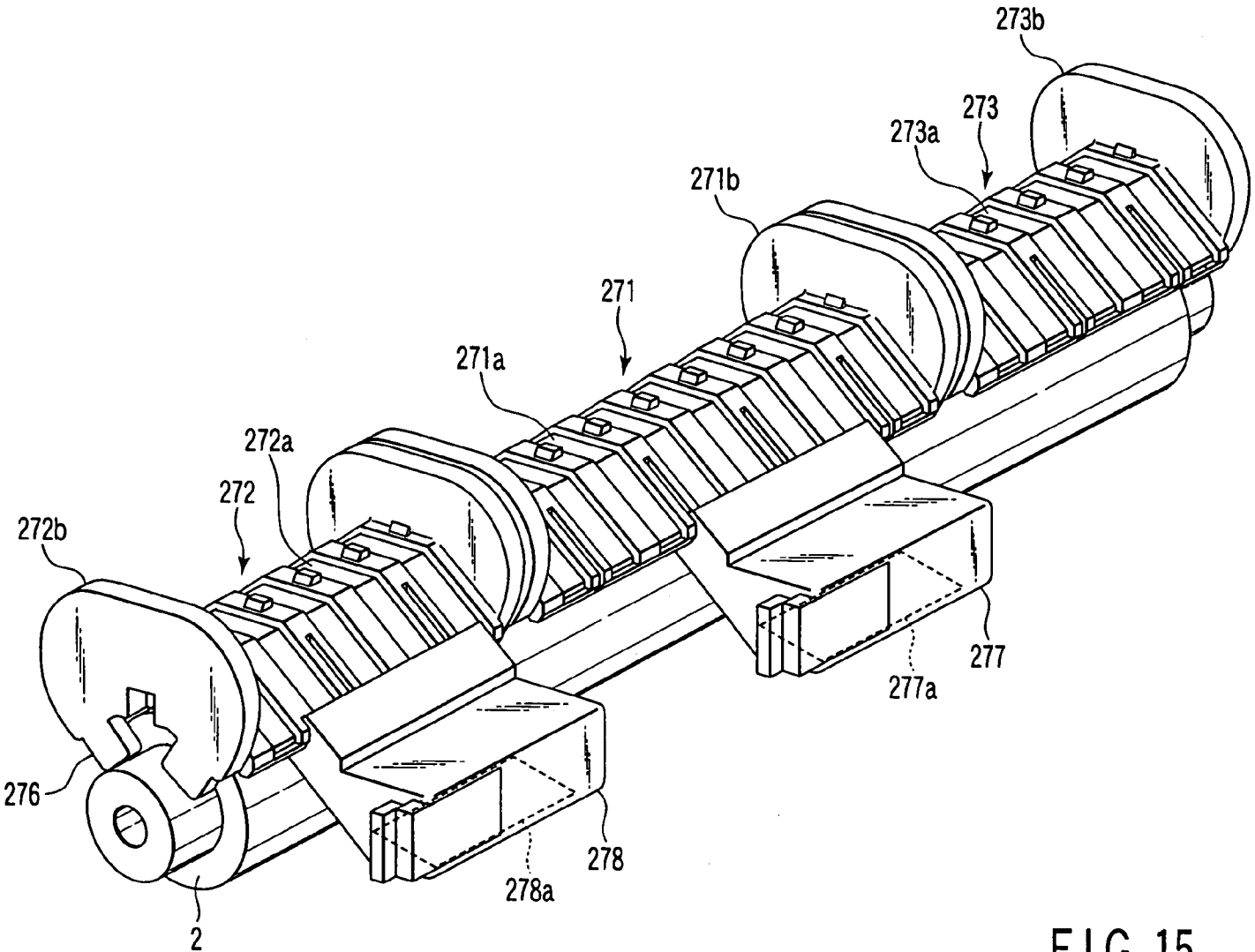
FIG. 15 is a schematic perspective view showing the coil unit shown in FIG. 14.

As shown in FIGS. 14 and 15, the fixing apparatus applicable to the present embodiment is provided with a coil unit 270, temperature sensors (non-contact temperature detecting sections) 281, 282, a temperature sensor 283, and a thermostat 291. Thermopile system sensors are used in the temperature sensors 281, 282.

The coil unit 270 includes coil units 171, 172, and 173 in which coil structures are integrally molded by injection molding, respectively. Among the coil units 171, 172, and 173, adjacent coil units are fixed and connected to each other via a predetermined fixing member 275. It is to be noted that screw members, adhesives or the like are usable as the fixing members 275. Moreover, the coil unit 270 has, in opposite ends in a longitudinal direction, abutting portions 276 which abut on abutment portions 200 fixed to a heating roller 2 via a shaft 2*a* of the heating roller 2 to position the heating roller 2 and the coil unit 270.

The coil unit 271 includes: a coil set 271*a* disposed facing a central portion of the heating roller 2 in an axial direction and including a coil holder, a coil structure, and a magnetic core having constitutions similar to those of the coil holder 70, the coil structure 71, and the magnetic core 72, respectively; and a coil mold 271*b* holding the coil set 271*a* by integral molding. The coil mold 271*b* includes a detector holder 277 which is disposed adjacent to the coil set 271*a* in a circumferential direction of the heating roller 2 and which is provided with the temperature sensor 281 and the thermostat 291. The detector holder 277 holds the temperature sensor 281 and the thermostat 291 in a predetermined position corresponding to the heating roller 2, and has a window portion 277*a* to which detecting surfaces of the temperature sensor 281 and the thermostat 291 are exposed on a side opposite to the heating roller 2.

The coil unit 272 includes: a coil set 272*a* disposed facing an end portion of the heating roller 2 in the axial direction and including a coil holder, a coil structure, and a magnetic core having constitutions similar to those of the coil holder 70, the coil structure 71, and the magnetic core 72, respectively; and a coil mold 272*b* holding the coil set 272*a* by integral molding. The coil mold 272*b* includes a detector holder 278 which is disposed adjacent to the coil set 272*a* in the circumferential direction of the heating roller 2 and which is provided with the temperature sensor 282. The detector holder 278 holds the temperature sensor 282 in a predetermined position corresponding to the heating roller 2, and has a window portion 278*a* to which a detecting surface of the temperature sensor 282 is exposed on the side opposite to the heating roller 2. The coil mold 272*b* is provided with an abutting portion 276 shown in FIG. 14 in the end portion of the heating roller 2 in the axial direction. That is, the coil unit 272 integrally holds a coil structure which supplies a magnetic field to the end portion of the heating roller 2, and the temperature sensor 282 which detects the surface temperature of the heating roller 2 heated by this coil structure.

The coil unit 273 includes: a coil set 273*a* including a coil holder, a coil structure, and a magnetic core having constitutions similar to those of the coil holder 70, the coil structure 71, and the magnetic core 72, respectively; and a coil mold 273*b* holding the coil set 273*a* by integral molding. The coil unit 273*b* includes an abutting portion 276 in an end portion of the heating roller 2 in the axial direction.

It is to be noted that in the present embodiment, the temperature sensors 281, 282, and the thermostat 291 are detachably mounted on the detector holders 277 and 278 via predetermined positioning members, respectively. However, the present invention is not limited to this embodiment. In a case where the temperature sensors 281, 282, and the thermostat 291 which are not required to be replaced owing to failures are applied, they may be integrally molded by means of the coil molds 271*b*, 272*b*. That is, they may be injection-molded together during the injection molding of the coil molds 271*b*, 272*b*. The positioning members may be pin-like members which determine positions of the temperature sensors 281, 282, and the thermostat 291, or screw members to fix the temperature sensors 281, 282, and the thermostat 291 while they abut on predetermined abutting portions.

As described above, the coil unit 270 integrally holds the coil units 171 to 173, the temperature sensors 281, 282, and the thermostat 291. Therefore, the coil unit 270 can maintain a certain positional relation defined by the injection-molded coil mold. Even in a case where the temperature sensors 281, 282, the thermostat 291 and the like are detached from the coil unit 270 because they have to be replaced or cleaned, positioning adjustment of them is facilitated, and operability of maintenance can be enhanced. It is to be noted that heat-resistant members having low thermal conductivities are applicable to the above-described predetermined positioning member and the predetermined fixing member 275.

Moreover, the coil units 271, 272 have a magnetic shield structure in which the temperature sensors 281, 282, and the thermostat 291 are prevented from being induction-heated by the magnetic fields generated from the respective coil structures. As this magnetic shield structure, for example, there is applicable: a structure in which a predetermined magnetic shield member 279 is disposed between the coil structure and the temperature sensors 281, 282 and thermostat 291; or a structure in which the temperature sensors 281, 282, and the thermostat 291 are detached from the coil structures, and held in positions that fail to be influenced by the magnetic fields from the coil structures. However, the present invention is not limited to the structure.

Furthermore, it has been described that in the present embodiment, the coil unit 270 includes the plurality of coil units 271 to 273 connected via the fixing member 275, but the present invention is not limited to this embodiment, and the coil sets 271*a* to 273*a* and the detector holders 277, 278 may be integrally held by the injection molding.

Additionally, the coil structures included in the coil units 272, 273 are connected in parallel to constitute one coil.

Moreover, as described above, the coil unit 270 is mounted on the side of the fixing apparatus, when the abutting portions 276 abut on the shaft 2*a* of the heating roller 2. That is, the coil unit 270 is drawn together with the fixing apparatus from an image forming apparatus for the purpose of maintenance or the like. However, the present invention is not limited to this embodiment, and the coil unit 270 may fixed on the side of the image forming apparatus whereas the fixing apparatus is drawn out, or the coil unit 270 remains to be held in the image forming apparatus.

Therefore, even when the drawn heating roller 2 is returned to its original position, an interval between the metal conductive layer 2*c* of the heating roller 2 and the coil structure can be reset to a predetermined distance without adjusting the position of the heating roller 2 with respect to the coil unit 270. In consequence, a maintenance property by a serviceman or the like is enhanced.

Fifth Embodiment

Next, there will be described another example of a fixing apparatus applicable to the present embodiment.

Figure 16:
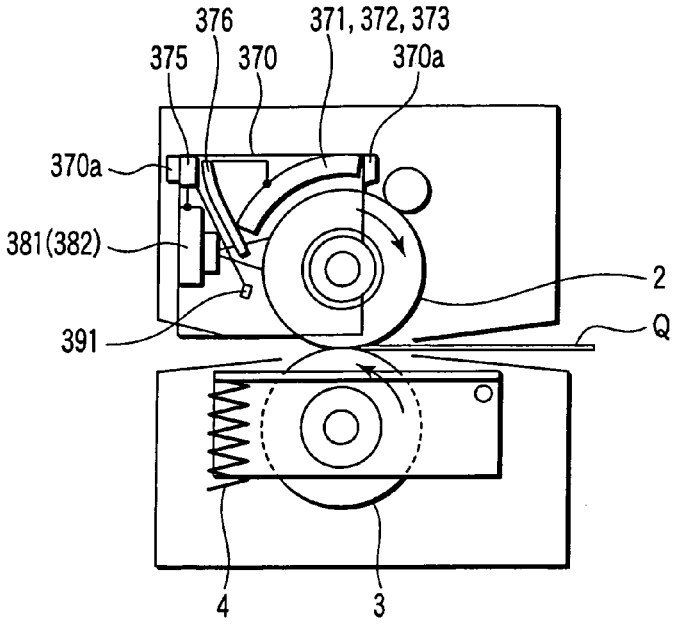
FIG. 16 is a schematic diagram showing another example of the coil unit applicable to the fixing apparatus shown in FIG. 1.
Figure 17:
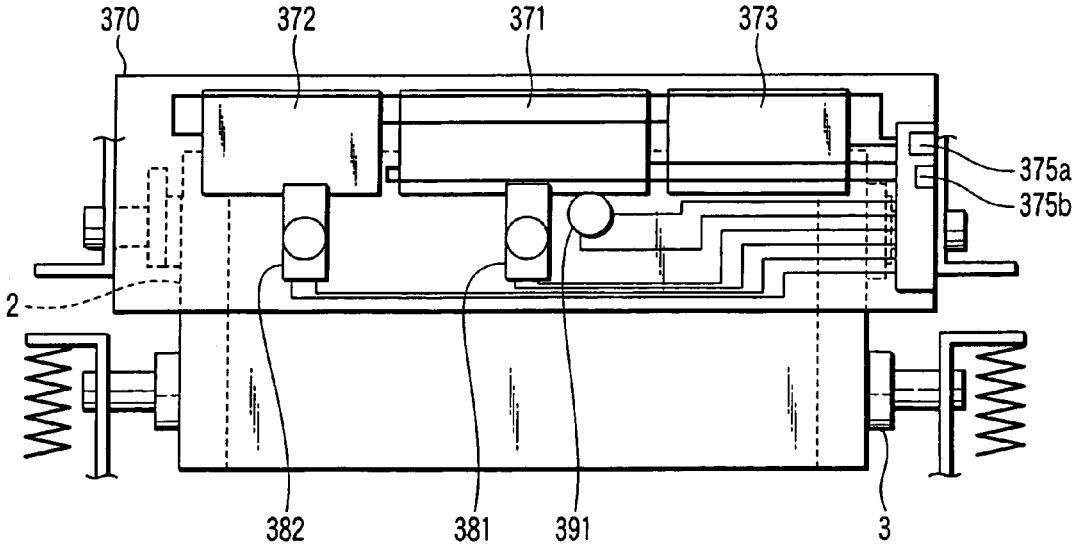
FIG. 17 is a schematic diagram showing the coil unit shown in FIG. 16.

As shown in FIGS. 16 and 17, the fixing apparatus applicable to the present embodiment includes a coil unit 370 provided with coil structures 371, 372, and 373, temperature sensors (non-contact temperature detecting sections) 381, 382, and a thermostat 391. The coil unit 370 is held in a predetermined position of the fixing apparatus via a slide member 370*a*. The coil unit 370 is drawn out of an image forming apparatus alone or together with a heating roller 2 and a pressurizing roller 3. It is to be noted that as the slide member 370*a*, a pair of slide structures are applicable one of which is fixed on the side of the fixing apparatus whereas the other is fixed to the coil unit 370.

The coil unit 370 integrally holds the coil structures 371 to 373 by injection molding, and detachably holds the temperature sensors 381, 382 and the thermostat 391 in predetermined positions. It is to be noted that in the injection molding, a method is applicable in which the coil structures 371 to 373 are disposed in a mold having a space corresponding to a constitution of the coil unit 370 directly or by use of the coil holder or the like, and the space is filled with a mold agent such as a resin material in the same manner as in the injection molding using the mold 10 or 15. It is to be noted that the coil unit 370 may hold a magnetic core as described above.

As shown in a sectional view of FIG. 16, the coil structures 371, 372, and 373 have shapes curved along a circumferential surface of the heating roller 2 in order to secure a uniform distance between the structures and the outer peripheral surface of the heating roller 2 in an axial direction. The coil structure 371 is disposed facing a central portion of the heating roller 2 in the axial direction, and the coil structures 372, 373 are disposed facing end portions of the heating roller 2 in the axial direction. The coil structures 372, 373 are connected in parallel to constitute one coil.

The temperature sensor 381 and the thermostat 391 are disposed in positions to detect a surface temperature of the heating roller 2 heated by the coil structure 371, the temperature sensor 382 is disposed in a position to detect the surface temperature of the heating roller 2 heated by the coil structure 372, and temperature detecting surfaces are exposed from the coil unit 370.

One end of the coil unit 370 is provided with a pair of connectors 375*a*, 375*b* for connecting harnesses drawn from the coil structure 371, one coil constituted of the coil structures 372 and 373, the temperature sensors 381 and 382, and the thermostat 391 to connectors (not shown) from the image forming apparatus. It is to be noted that the connectors 375*a*, 375*b* are preferably coated or subjected to electromagnetic waves shield treatment so that they are not influenced by the electromagnetic waves from the coil structures 371 to 373.

The connectors 375*a*, 375*b* include a plurality of power supplying harnesses and signal harnesses from the coil structure 371, one coil constituted of the coil structures 372 and 373, the temperature sensors 381 and 382, and the thermostat 391, and function as connectors connected to all of the harnesses from the components mounted in the coil unit 370.

A magnetic shield member 376 is disposed between the temperature sensors 381 and 382, thermostat 391, and connectors 375*a*, 375*b* and the coil structures 371 to 373.

According to such constitution, when the harness on the side of the image forming apparatus is connected to the coil unit 370, it may be simply connected to the connector 375. Therefore, an operation efficiency is satisfactory. Moreover, the fixing apparatus is detachably mounted on the coil unit 370 via the slide member 370*a* as described above. Therefore, when the connection to the image forming apparatus is simplified, an operation efficiency during maintenance of the coil unit 370 is also enhanced.

Sixth Embodiment

Next, there will be described another example of a fixing apparatus applicable to the present embodiment.

Figure 18:
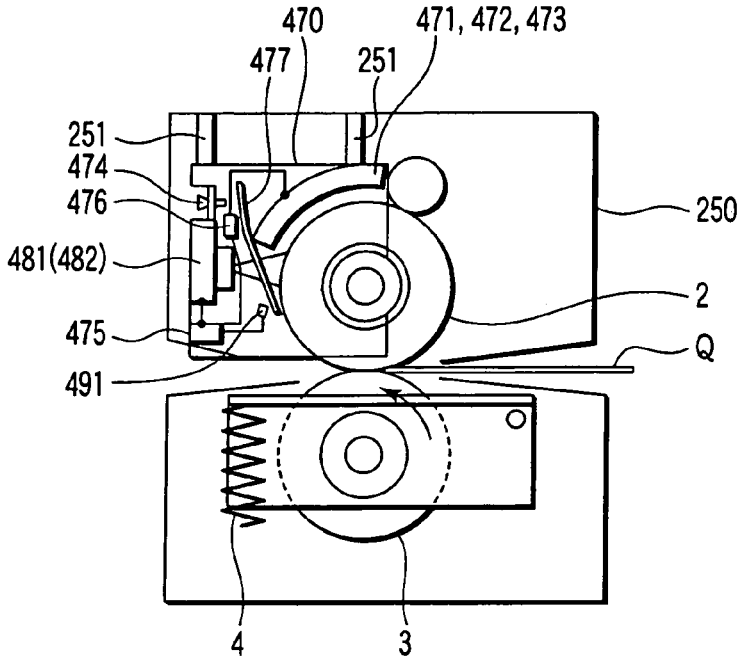
FIG. 18 is a schematic diagram showing another example of the coil unit applicable to the fixing apparatus shown in FIG. 1.
Figure 19:
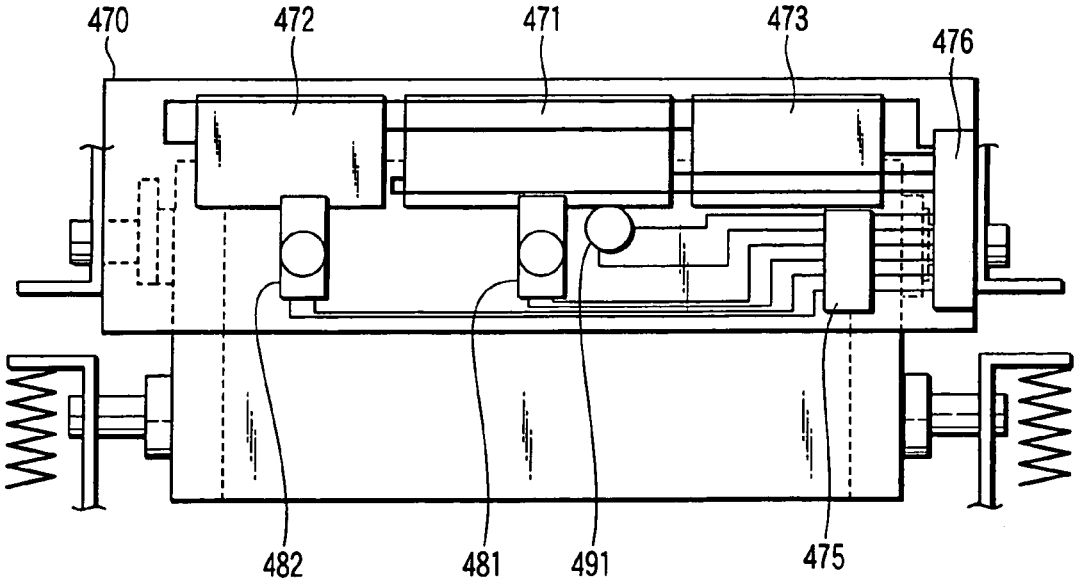
FIG. 19 is a schematic diagram showing the coil unit shown in FIG. 18.

As shown in FIGS. 18 and 19, the fixing apparatus applicable to the present embodiment includes a coil unit 470 provided with coil structures 471, 472, and 473, temperature sensors 481, 482, and a thermostat 491. The coil unit 470 is fixed to a predetermined position of a case 250 of the fixing apparatus via a predetermined fixing member 251. That is, since the coil unit 470 is fixed on the side of the image forming apparatus, the coil unit is not drawn out together with a heating roller 2 and a pressurizing roller 3 even when they are drawn out.

The coil structures 471, 472, and 473 are integrally disposed in the coil unit 470 by injection molding. As shown in a sectional view of FIG. 18, the coil structures 471, 472, and 473 have shapes curved along a circumferential surface of the heating roller 2 to secure a certain distance between the structures and an outer peripheral surface of the heating roller 2 in an axial direction. The coil structure 471 is disposed facing a central portion of the heating roller 2 in the axial direction, and the coil structures 472 and 473 are disposed facing end portions of the heating roller 2 in the axial direction. The coil structures 472 and 473 are connected in parallel to constitute one coil.

The temperature sensors 481, 482 and the thermostat 491 are detachably held with respect to the coil unit 470 by means of a plurality of fixing members (e.g., screws) 474. The temperature sensor 481 and the thermostat 491 are disposed in positions to detect a surface temperature of the heating roller 2 heated by the coil structure 471, the temperature sensor 482 is disposed in a position to detect the surface temperature of the heating roller 2 heated by the coil structure 472, and temperature detecting surfaces are exposed from the coil unit 470.

Moreover, the temperature sensors 481, 482 and the thermostat 491 are electrically connected to a connector (not shown) on the side of an image forming apparatus via a connector 475.

One end of the coil unit 470 is provided with a connector 476 for connecting harnesses drawn from the connector 475 for the temperature sensors 481, 482 and the thermostat 491, the coil structure 471, and one coil constituted of the coil structures 472 and 473 to the connector (not shown) from the image forming apparatus. That is, the coil structures 471 to 473 and the connector 475 are disposed integrally in the coil unit 470 simultaneously with the injection molding of the coil unit 470, and connected to the connector 476. In other words, the connector 475 is a relay connector disposed to connect the detachable temperature sensors 481, 482 and thermostat 491 to the connector on the side of the image forming apparatus. It is to be noted that the connector 475 may be disposed in the vicinity of the coil structure 473 as shown in FIG. 19, or in the vicinity of the temperature sensors 481, 482 and the thermostat 491.

A magnetic shield member 477 is disposed between the temperature sensors 481 and 482, thermostat 491, and connectors 475 and 476 and the coil structures 471, 472, and 473. The connectors 475, 476 are preferably coated or subjected to electromagnetic waves shield treatment so that they are not influenced by electromagnetic waves from the coil structures 471 to 473.

As described above, since the members disposed in the vicinity of the coil structures 471 to 473 are provided with the constitution to shield them from influences of magnetic fields from the coil structures 471 to 473, it is possible to avoid a problem that the members disposed in the vicinity of the coil structures 471 to 473 are induction-heated, or noises are generated under the influences of the magnetic fields.

According to the above-described constitution, even when a user draws the heating roller 2 and the pressurizing roller 3 from the image forming apparatus because of paper clogging or the like, the coil unit 470 remains to be mounted on the image forming apparatus, and therefore a high security is secured. Since the coil unit 470 is fixed to the image forming apparatus even during maintenance by a serviceman or the like, operability is satisfactory.

In other words, the coil unit 470 includes the so-called maintenance-free coil structures 471 to 473 which are hardly required to be replaced or maintained. Since the maintenance-free coil structures 471 to 473 are fixed on the side of the image forming apparatus, the maintenance-free components do not hinder a maintenance operation during the maintenance of the other components requiring the maintenance, and the operability of the maintenance is enhanced. For example, when a roller of the fixing apparatus constituted of the coil structure mounted on the heating roller 2, the pressurizing roller 3 or the like, the coil structure needs to be removed before disposing a new heating roller 2 or pressurizing roller 3. Therefore, it is necessary to adjust a positional relation between the coil structure and the heating roller 2 or the pressurizing roller 3 during re-assembling. However, when the coil unit 470 is fixed on the side of the image forming apparatus as in the present embodiment, adjustment with respect to the coil unit 470 is not required, the new heating roller 2 or pressurizing roller 3 may be simply returned to its original position, and the operation efficiency is satisfactory. According to such constitution, since the number of maintenance operations is small, the positional relation between the heating roller 2 and the coil structures 471 to 473 does not easily change, and optimum fixing conditions are easily maintained.

Moreover, since there is disposed the connector 475 for the temperature sensors 481, 482 and the thermostat 491 that are detachable members, the temperature sensors 481, 482, the thermostat 491 and the like can be easily replaced.

Figure 20:
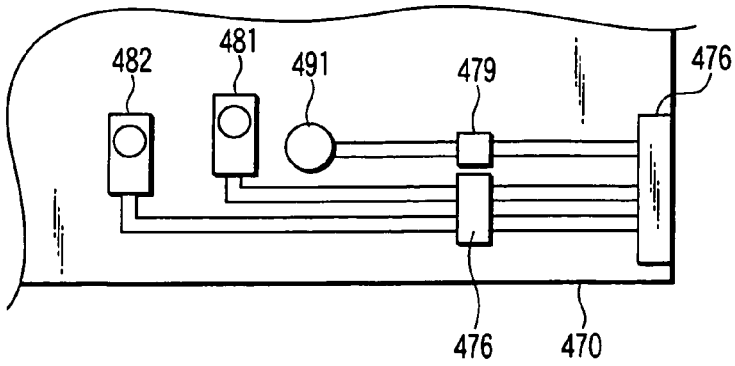
FIG. 20 is a schematic diagram showing an example which is different from the coil unit shown in FIG. 19.

It is to be noted that the present invention is not limited to the above-described embodiment, and may have a constitution shown in, for example, FIG. 20. That is, a connector for the temperature sensors 481, 482 may be separated from that for the thermostat 491.

Furthermore, as shown in FIG. 20, the coil unit 470 may include a connector 478 for the temperature sensors 481 and 482, a connector 479 for the thermostat 491, and a connector 476 connected to the connectors 478 and 479 in a main body of the coil unit 470.

As described above, when the connector for the temperature sensor is separated from that of the thermostat, the operation efficiency can be expected to be enhanced during the replacement, maintenance or the like of the temperature sensor or the thermostat.

Moreover, the coil unit 470 may be constituted such that magnetic cores for the coil structures 471 to 473, respectively, are integrally molded by the injection molding.

Seventh Embodiment

Next, there will be described another example of a fixing apparatus applicable to the present embodiment.

Figure 21:
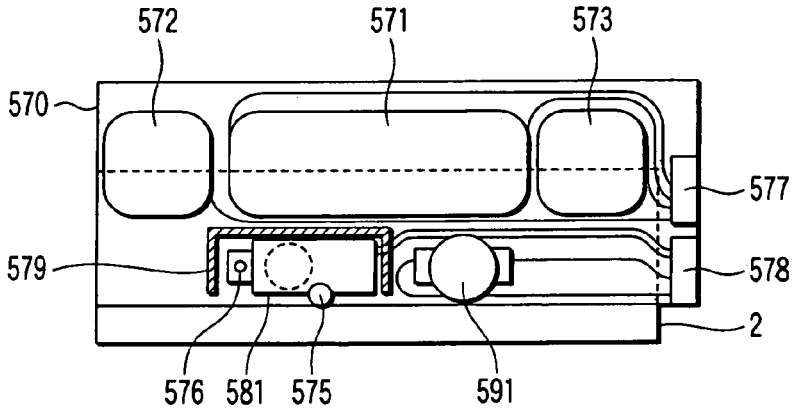
FIG. 21 is a schematic diagram showing another example of the coil unit applicable to the fixing apparatus shown in FIG. 1.
Figure 22:
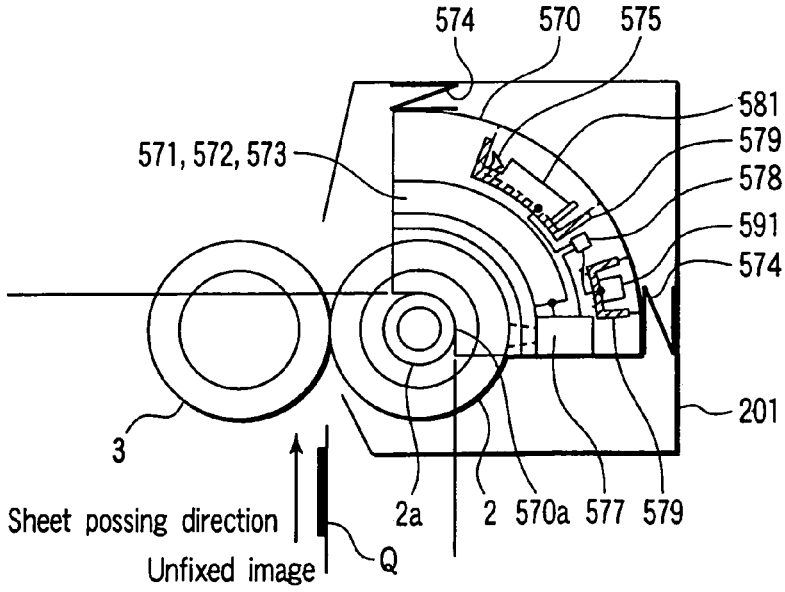
FIG. 22 is a schematic diagram showing the coil unit shown in FIG. 21.

As shown in FIGS. 21 and 22, the fixing apparatus applicable to the present embodiment includes a coil unit 570 provided with coil structures 571, 572, and 573, a temperature sensor 581, and a thermostat 591. The coil unit 570 is attached to a shaft 2*a* of a heating roller 2 via an abutting portion 570*a*, and held while pressurized by a pressurizing member 574 disposed in a predetermined position between a case 201 of the fixing apparatus and the coil unit 570. That is, when the coil unit 570 is brought into contact with the shaft 2*a* under pressure by the pressurizing member 574, a distance between the unit and the appropriate heating roller 2 can be maintained.

The coil structures 571, 572, and 573 are integrally disposed in the coil unit 570 by injection molding. As shown in a sectional view of FIG. 22, the coil structures 571, 572, and 573 have shapes curved along an outer peripheral surface of the heating roller 2 so that a uniform distance is secured between the structures and the outer peripheral surface of the heating roller 2. The coil structure 571 is disposed facing a central portion of the heating roller 2 in the axial direction, and the coil structures 572, 573 are disposed facing end portions of the heating roller 2 in the axial direction. The coil structures 572, 573 are connected in parallel to constitute one coil.

The temperature sensor 581 and the thermostat 591 are detachably held with respect to the coil unit 570. The temperature sensor 581 and the thermostat 591 are disposed in positions to detect a surface temperature of the heating roller 2 heated by the coil structure 571.

To be more specific, the temperature sensor 581 is positioned in a position corresponding to the heating roller 2 via a predetermined positioning member (e.g., positioning pin) 575, and fixed to the coil unit 570 via a fixing member (e.g., screw) 576. The thermostat 591 is detachably held with respect to the coil unit 570 via a predetermined fixing member (not shown).

One end of the coil unit 570 is provided with a connector 577 for connecting harnesses drawn from the coil structure 571 and one coil constituted of the coil structures 572 and 573 to a connector (not shown) from the image forming apparatus, and a connector 578 for connecting harnesses drawn from the temperature sensor 581 and the thermostat 591 to a connector (not shown) from the image forming apparatus.

That is, the coil structures 571 to 573 and the connectors 577, 578 are integrally molded simultaneously with the injection molding of the coil unit 570, and the coil structures 571 to 573 are electrically connected to the connector 577 in a main body of the coil unit 570. The connector 578 is disposed to connect the detachable temperature sensor 581 and thermostat 591 to the connector on the side of the image forming apparatus.

A magnetic shield member 579 is disposed between the temperature sensor 581 and thermostat 591 and the coil structure 571. The connectors 577, 578 are preferably coated or subjected to electromagnetic waves shield treatment so that the connectors are not influenced by electromagnetic waves from the coil structures 571 to 573. Since there is disposed the constitution to shield the connectors from influences of magnetic fields from the coil structures 571 to 573, it is possible to avoid a problem that members disposed in the vicinity of the coil structures 571 to 573 are induction-heated or noises are generated under the influences of the magnetic fields.

According to the above-described constitution, even when the coil unit 570 is detached during maintenance by a serviceman or the like, it is easy to reset the state to a state in which an appropriate distance is secured between the heating roller 2 and the coil structures 571 to 573.

It is to be noted that a spiral spring, a leaf spring or the like is usable as the above-described pressurizing member 574.

The present invention is not limited to the above-described embodiments as such, and can be embodied by transforming constituting elements without departing from the scope of the present invention in an implementing stage. Various inventions can be formed by an appropriate combination of a plurality of constituting elements disclosed in the above-described embodiments. For example, several constituting elements may be deleted from all of the constituting elements described in the embodiments. Furthermore, the constituting elements of different embodiments may be appropriately combined.

For example, the magnetic core 72 shown in FIG. 2 is constituted of one member which continues in a longitudinal direction, but the present invention is not limited to this embodiment, and the core may be constituted of a plurality of magnetic core members.

Moreover, the coil holder 70 may be constituted of the same material as that of the coil mold 73. In this case, since a bonding property between the coil holder 70 and the coil mold 73 is satisfactory, a filling material can be filled without any gap.

Furthermore, in the fixing apparatus using a plurality of coils, a plurality of lead wires of the coils may be provided with protecting members (sleeves), respectively, as shown in FIGS. 10 and 11. It is to be noted that in an induction heating unit constituted of two coils, when four lead wires are provided with the sleeves, respectively, it is possible to prevent deteriorations of the lead wires positioned in inlet and outlet portions of the coil mold.

In addition, the above-described temperature sensor may be constituted such that a temperature of one place can be detected by one element, or a non-contact temperature detecting element may be used in which temperatures of two or more places are detected by one element. The above-described temperature sensors are preferably disposed in the outer peripheral surface of the heating roller 2 facing the central coil structure, and a position to detect the temperature of the outer peripheral surface of the heating roller 2 facing the end-portion coil structure, but the present invention is not limited to this constitution, and the sensors may be disposed in joints between the coil structures or a position to detect the temperature of the outer peripheral surface of the heating roller 2 facing all of the coil structures.

Moreover, in all of the above-described embodiments, a contact-type sensor brought into contact with the end portion (non-sheet-passing area) of the heating roller 2 may be used together, and this contact-type sensor may be fixed to the coil unit in which the coil structures are integrally molded.

Furthermore, the fixing apparatus of the present invention may be a fixing apparatus capable of performing color copying or monochromatic copying.

What is claimed is:

1. A coil unit comprising:

a coil having a first surface and a second surface disposed on a side opposite to the first surface;

a first holding member which holds the coil disposed facing the first surface, the first holding member having a plurality of ribs which are arranged at predetermined intervals from one another in a first direction;

a magnetic core disposed at a predetermined interval from the second surface of the coil, the magnetic core having support portions corresponding to the plurality of ribs on a side facing the coil, and being set in a predetermined position with respect to the first holding member in a state in which a predetermined interval is formed from the coil, when the support portions are set in the plurality of ribs of the first holding member; and a second holding member covering the magnetic core and holding the magnetic core and the coil between the first and second holding members.

2. The coil unit according to claim 1, wherein the first holding member, the coil, and the magnetic core are injection-molded of a resin in fixed states, and molded integrally with the second holding member.

3. The coil unit according to claim 1, further comprising:

a third holding member which is disposed between the coil and the magnetic core and which maintains a certain interval between the coil and the magnetic core.

4. The coil unit according to claim 1, wherein the first holding member is constituted of the same material as that of the second holding member, and a molding temperature of a resin of the first holding member is different from that of a resin of the second holding member.

5. The coil unit according to claim 1, further comprising: a temperature detecting section which detects a temperature of a heating object to be heated by the coil and which is held integrally by the second holding member by injection molding.

6. The coil unit according to claim 1, further comprising: a temperature detecting section which detects a temperature of a heating object to be heated by the coil and which is detachably disposed with respect to the second holding member.

7. The coil unit according to claim 6, wherein the second holding member includes a magnetic shield member between the temperature detecting section and the coil.

8. The coil unit according to claim 6, wherein the second holding member is provided with a first connector connected to the coil and the temperature detecting section in the second holding member.

9. The coil unit according to claim 6, wherein the second holding member is provided with a first connector connected to the temperature detecting section, and a second connector connected to the coil and the first connector in the second holding member.

10. A coil unit comprising:

a coil having a first surface and a second surface disposed on a side opposite to the first surface;

a first holding member which holds the coil disposed facing the first surface, the first holding member having a plurality of ribs which are arranged at predetermined intervals from one another in a first direction; and a magnetic core disposed at a predetermined interval from the second surface of the coil, the magnetic core having support portions corresponding to the plurality of ribs on a side facing the coil, and being set in a predetermined position with respect to the first holding member in a state in which a predetermined interval is formed from the coil, when the support portions are set in the plurality of ribs of the first holding member.

11. The coil unit according to claim 10, wherein the magnetic core includes, as the support portions, a plurality of protruding portions to engage with the plurality of ribs, and the first holding member holds the magnetic core in a first direction, when the plurality of ribs engage with the plurality of protruding portions.

12. The coil unit according to claim 10, wherein the ribs are provided with first position matching portions which set the magnetic core in a predetermined position of the first holding member, and the magnetic core is provided with second position matching portions corresponding to the first position matching portions, and is set in a predetermined position with respect to the first holding member while held in a second direction different from the first direction, when the second position matching portions are set in the first position matching portions.

13. The coil unit according to claim 10, wherein the coil is constituted of an electric wire subjected to a self fusing treatment.

14. The coil unit according to claim 10, wherein a lead wire of the coil is drawn out of the coil unit via a protecting member.

15. The coil unit according to claim 14, wherein the protecting member is constituted of an elastic material.

16. The coil unit according to claim 14, wherein the protecting member is a hollow member, the lead wire of the coil is passed through a central cavity of the hollow member, and the hollow member is bonded to the lead wire of the coil via a heat-resistant adhesive which fills in the central cavity.

17. A fixing apparatus comprising:

a heating roller which supplies heat to a recording medium;

a pressurizing roller which is brought into contact with the heating roller under pressure while applying a predetermined pressure to the heating roller; and a heating device provided with a coil unit which induction-heats the heating roller, the coil unit including: a coil having a first surface, a second surface disposed on a side opposite to the first surface, and a coil hole positioned in the center; a first mold which is provided with a first support portion disposed in the coil hole and which holds the coil disposed facing the first surface, the first support portion having a plurality of ribs which are arranged at predetermined intervals from one another in a first direction; and a magnetic core disposed at a predetermined interval from the second surface of the coil, the magnetic core having support portions corresponding to the plurality of ribs on a side facing the coil, and being set in a predetermined position with respect to the first mold in a state in which a predetermined interval is formed from the coil, when the support portions are set in the plurality of ribs of the first support portion.

18. The fixing apparatus according to claim 17, wherein the magnetic core includes, as the support portions, a plurality of protruding portions to engage with the plurality of ribs, and the first mold holds the magnetic core in the first direction, when the plurality of ribs engage with the plurality of protruding portions.

19. The fixing apparatus according to claim 17, wherein the plurality of ribs are provided with first position matching portions which set the magnetic core in a predetermined position of the first support portion, and the magnetic core is provided with second position matching portions corresponding to the first position matching portions, and is set in a predetermined position with respect to the first mold while held in a second direction different from the first direction, when the second position matching portions are set in the first position matching portions.

20. The fixing apparatus according to claim 17, wherein the coil unit includes an abutting portion which is pressed onto a shaft of the heating roller to maintain a predetermined interval between the coil and the heating roller and which is pressed onto the heating roller by an elastic member disposed on a side of the coil unit opposite to the heating roller.

* * * * *